US009908601B2

(12) United States Patent
Vachon

(10) Patent No.: US 9,908,601 B2
(45) Date of Patent: Mar. 6, 2018

(54) METHOD FOR DECELERATING A WATERCRAFT

(71) Applicant: BOMBARDIER RECREATIONAL PRODUCTS INC., Valcourt (CA)

(72) Inventor: Frederic Vachon, Granby (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 0 days.

(21) Appl. No.: 15/268,045

(22) Filed: Sep. 16, 2016

(65) Prior Publication Data

US 2017/0152012 A1 Jun. 1, 2017

Related U.S. Application Data

(60) Provisional application No. 62/261,189, filed on Nov. 30, 2015.

(51) Int. Cl.
*B63H 11/11* (2006.01)
*B63B 35/73* (2006.01)

(52) U.S. Cl.
CPC ..... *B63H 11/11* (2013.01); *B63B 35/731* (2013.01)

(58) Field of Classification Search
CPC ..... B63H 25/48; B63H 11/11
See application file for complete search history.

(56) References Cited

U.S. PATENT DOCUMENTS 6,533,623 B2 3/2003 Simard et al.
7,124,703 B2 10/2006 Richard et al.
7,674,144 B2 3/2010 Bourret et al.
7,708,609 B2 5/2010 Plante et al.
7,775,844 B2 8/2010 St-Pierre et al.
7,841,915 B2 11/2010 Bourret et al.
7,892,053 B2 2/2011 St-Pierre et al.
7,901,259 B2 3/2011 Bourret et al.
8,000,851 B2 8/2011 St-Pierre et al.
8,166,900 B2 5/2012 Kamio
8,177,592 B2 5/2012 Kamio
8,177,594 B2 5/2012 Dagenais et al.
8,202,136 B2 6/2012 Dagenais et al.
8,478,465 B2 7/2013 St-Pierre et al.
2010/0151752 A1* 6/2010 Hattori ..... B63B 35/731 440/41
2012/0021659 A1 1/2012 Ota

FOREIGN PATENT DOCUMENTS

WO 2008025169 A1 3/2008

* cited by examiner

*Primary Examiner* — Stephen P Avila
(74) *Attorney, Agent, or Firm* — BCF LLP

(57) ABSTRACT

A method for decelerating a watercraft is disclosed. The watercraft has a reverse gate and a reverse gate actuator operatively connected to the reverse gate for moving the reverse gate between at least a stowed position and a deceleration position. The method includes: receiving, in a control unit, a deceleration signal from a deceleration device position sensor, the deceleration signal being indicative of an actuated position of a deceleration device; controlling, by the control unit, an operation of the reverse gate actuator based at least in part on the actuated position of the deceleration device; and moving the reverse gate from the stowed position to the deceleration position with the reverse gate actuator, the reverse gate actuator being controlled such that a speed of rotation of the reverse gate depends at least in part on the actuated position of the deceleration device.

20 Claims, 25 Drawing Sheets

METHOD FOR DECELERATING A WATERCRAFT

CROSS-REFERENCE

The present application claims priority to U.S. Provisional Patent Application No. 62/261,189, filed Nov. 30, 2015, the entirety of which is incorporated herein by reference.

FIELD OF TECHNOLOGY

The present technology relates to a method for decelerating a watercraft.

BACKGROUND

In jet propelled watercraft, such as personal watercraft or jet propelled boats, the watercraft can be propelled in reverse by lowering a reverse gate behind the output of the water jet thus redirecting the jet toward the front of the watercraft which creates a thrust in the reverse direction. The reverse gate is actuated by a hand activated reverse gate operator which, when pulled, lowers the reverse gate behind of the water jet. By actuating a throttle operator of the watercraft, the amount of thrust generated by the jet propulsion system changes. Therefore, by controlling the position of the reverse gate and the amount of thrust generated by the jet propulsion system, and by actuating the reverse gate operator and the throttle operator respectively, the driver of the watercraft can control the amount of reverse thrust being generated.

The reverse thrust that can be generated when the reverse gate is lowered can also be used to decelerate the watercraft. In one method for decelerating the watercraft using the reverse gate, a deceleration lever is actuated by the driver in response to which the motor speed is reduced, when the motor speed is sufficiently low, the reverse gate pivots toward a fully lowered position, and once the reverse gate reaches the fully lowered position the motor speed is increased to generate a reverse thrust to decelerate the watercraft.

One inconvenience of the above method is that the watercraft decelerates in three stages of deceleration that are noticeable to the driver of the watercraft. The first stage of deceleration occurs when the motor speed is first reduced. This first stage of deceleration results from friction between the hull and water and from the resistance of the water to being displaced by the hull. The second stage of deceleration occurs when the reverse gate starts to protrude below the hull and drags in the water. The third stage occurs once the reverse gate reaches the fully lowered position and the reverse thrust is applied by increasing the motor speed. Each time a stage is reached, the driver can feel the resulting sudden increase in deceleration.

SUMMARY

It is an object of the present technology to ameliorate at least some of the inconveniences present in the prior art.

In one aspect, implementations of the present technology provide a method for decelerating a watercraft. The watercraft has a hull, a deck disposed on the hull, a seat disposed on the deck, a motor connected to at least one of the hull and the deck, a jet propulsion system operatively connected to the motor, a reverse gate connected to at least one of the hull and the jet propulsion system, the reverse gate being movable between at least a stowed position and a deceleration position, and a reverse gate actuator operatively connected to the reverse gate for moving the reverse gate between at least the stowed position and the deceleration position. The method comprises: receiving, in a control unit, a deceleration signal from a deceleration device position sensor, the deceleration signal being indicative of an actuated position of a deceleration device; controlling, by the control unit, an operation of the reverse gate actuator based at least in part on the actuated position of the deceleration device; and moving the reverse gate from the stowed position to the deceleration position with the reverse gate actuator, the reverse gate actuator being controlled such that a speed of rotation of the reverse gate depends at least in part on the actuated position of the deceleration device.

In some implementations of the present technology, controlling the operation of the reverse gate actuator includes: controlling the reverse gate actuator to operate according to a first operation mode as the reverse gate moves from the stowed position to an intermediate position of the reverse gate, the intermediate position being intermediate the stowed and deceleration positions; and controlling the reverse gate actuator to operate according to a second operation mode as the reverse gate moves from the intermediate position to the deceleration position. The speed of rotation of the reverse gate depends at least in part on the one of the first and second operation modes according to which the reverse gate actuator is being controlled.

In some implementations of the present technology, the reverse gate actuator moves the reverse gate faster in the first operation mode than in the second operation mode.

In some implementations of the present technology, the first operation mode is independent of the actuated position of the deceleration device; and the second operation mode is dependent on the actuated position of the deceleration device.

In some implementations of the present technology, in the second operation mode, the reverse gate actuator moves the reverse gate slower as the actuated position of the deceleration device is smaller.

In some implementations of the present technology, controlling the reverse gate actuator to operate according to the first operation mode includes applying a first power level to the reverse gate actuator, the first power level is independent of the actuated position of the deceleration device; and controlling the reverse gate actuator to operate according to the second operation mode includes applying a second power level to the reverse gate actuator. The second power level is dependent on the actuated position of the deceleration device. The second power level is smaller as the actuated position of the deceleration device is smaller. The second power level is smaller than the first power lever.

In some implementations of the present technology, controlling the reverse gate actuator to operate according to the first operation mode includes applying a first power level to the reverse gate actuator; and controlling the reverse gate actuator to operate according to the second operation mode includes applying a second power level to the reverse gate actuator. The second power level is smaller than the first power lever.

In some implementations of the present technology, moving the reverse gate toward the deceleration position with the reverse gate actuator includes: moving the reverse gate from the stowed position to the intermediate position with the reverse gate actuator operating according to the first operation mode; stopping the reverse gate at the intermediate position for a time delay; and, once the time delay has expired, moving the reverse gate from the intermediate position to the deceleration position with the reverse gate actuator operating according to the second operation mode.

In some implementations of the present technology, the time delay is constant.

In some implementations of the present technology, the intermediate position is a neutral position of the reverse gate.

In some implementations of the present technology, when the actuated position of the reverse gate actuator is less than a predetermined position, controlling the operation of the reverse gate actuator includes: controlling the reverse gate actuator to operate according to a first operation mode as the reverse gate moves from the stowed position to an intermediate position of the reverse gate, the intermediate position being intermediate the stowed and decelerations positions; and controlling the reverse gate actuator to operate according to a second operation mode as the reverse gate moves from the intermediate position to the deceleration position. When the actuated position of the reverse gate actuator is greater than the predetermined position, controlling the operation of the reverse gate actuator includes: controlling the reverse gate actuator to operate according to a third operation mode as the reverse gate moves from the stowed position to the deceleration position. The speed of rotation of the reverse gate depends at least in part on the one of the first, second and third operation modes according to which the reverse gate actuator is being controlled.

In some implementations of the present technology, the reverse gate actuator moves the reverse gate faster in the first and third operation modes than in the second operation mode.

In some implementations of the present technology, the first and third operation modes are independent of the actuated position of the deceleration device; and the second operation mode is dependent on the actuated position of the deceleration device.

In some implementations of the present technology, when the actuated position of the reverse gate actuator is less than the predetermined position, moving the reverse gate toward the deceleration position with the reverse gate actuator includes: moving the reverse gate from the stowed position to the intermediate position with the reverse gate actuator operating according to the first operation mode; stopping the reverse gate at the intermediate position for a time delay; and once the time delay has expired, moving the reverse gate from the intermediate position to the deceleration position with the reverse gate actuator operating according to the second operation mode. When the actuated position of the reverse gate actuator is greater than the predetermined position, moving the reverse gate toward the deceleration position with the reverse gate actuator includes: moving the reverse gate uninterruptedly from the stowed position to the deceleration position with the reverse gate operating according to the third operation mode.

In some implementations of the present technology, the method further comprises: reducing a thrust request upon receiving the deceleration signal prior to moving the reverse gate toward the deceleration position; reducing a speed of the motor in response to the reduction of the thrust request; continuing to reduce the speed of the motor as the reverse gate moves toward an intermediate position of the reverse gate, the intermediate position being intermediate the stowed and decelerations positions; increasing the thrust request at the intermediate position of the reverse gate; and increasing the speed of the motor in response to increasing the thrust request.

In some implementations of the present technology, the intermediate position is between a neutral position of the reverse gate and the deceleration position of the reverse gate.

In some implementations of the present technology, controlling the reverse gate actuator includes applying a power level to the reverse gate actuator, the power level being based at least in part on the actuated position of the deceleration device.

In another aspect, implementations of the present technology provide a watercraft having a hull, a deck disposed on the hull, a seat disposed on the deck, a motor connected to one of the hull and the deck, a jet propulsion system operatively connected to the motor, an electronic control unit (ECU) communicating with the motor for controlling an operation of the motor, a reverse gate operatively connected to at least one of the hull and the jet propulsion system, the reverse gate being movable between at least a stowed position and a deceleration position, a reverse gate actuator operatively connected to the reverse gate for moving the reverse gate between at least the stowed position and the deceleration position, and being in communication with the ECU, a deceleration device position sensor in communication with the ECU, and a deceleration device connected to the deceleration device position sensor. The deceleration device position sensor sensing a position of the deceleration device. The ECU is configured to, upon receiving a deceleration signal indicative of an actuation of the deceleration device from the deceleration device position sensor, send an actuation signal to the reverse gate actuator to move the reverse gate toward the deceleration position. The actuation signal is based at least in part on the actuated position of the deceleration device. A speed of rotation of the reverse gate depends at least in part of the actuated position of the deceleration device.

In some implementations of the present technology, the actuation signal includes a first actuation signal and a second actuation signal. The ECU is configured to, upon receiving the deceleration signal indicative of the actuation of the deceleration device from the deceleration device position sensor: send the first actuation signal to the reverse gate actuator to move the reverse gate from the stowed position to an intermediate position of the reverse gate, the intermediate position being intermediate the stowed and decelerations positions; and send the second actuation signal to the reverse gate actuator to move the reverse gate from the intermediate position to the deceleration position. The reverse gate actuator moves the reverse gate faster when the ECU sends the first actuation signal than when the ECU sends the second actuation signal.

In some implementations of the present technology, the reverse gate actuator is an electric motor.

In another aspect, implementations of the present technology provide a method for decelerating a watercraft. The watercraft has a hull, a deck disposed on the hull, a seat disposed on the deck, a motor connected to at least one of the hull and the deck, a jet propulsion system operatively connected to the motor, a reverse gate connected to at least one of the hull and the jet propulsion system, the reverse gate being movable between at least a stowed position and a deceleration position, and a reverse gate actuator operatively connected to the reverse gate for moving the reverse gate between at least the stowed position and the deceleration position. The method comprises: receiving, in a control unit, a deceleration signal from a deceleration device position sensor, the deceleration signal being indicative of an actuated position of a deceleration device; controlling, by the control unit, an operation of the reverse gate actuator based at least in part on the actuated position of the deceleration device; and moving the reverse gate from the stowed position to the deceleration position with the reverse gate actuator. The reverse actuator being controlled such that a time taken for moving the reverse gate from the stowed position to the deceleration position varies depending at least in part on the actuated position of the deceleration device. The time starts from the reception of the deceleration signal by control unit.

In some implementations of the present technology, the operation of the reverse gate actuator is controlled such that an average speed of rotation of the reverse gate over the time is based at least in part on the actuated position of the deceleration device.

In some implementations of the present technology, the operation of the reverse gate actuator is controlled such that an instantaneous speed of rotation of the reverse gate varies from the stowed position to the deceleration position.

In some implementations of the present technology, the operation of the reverse gate actuator is controlled such that the time includes a delay. The reverse gate actuator is controlled to keep the reverse gate in a fixed position during the delay.

In some implementations of the present technology, the fixed position is an intermediate position. The intermediate position is intermediate the stowed and deceleration positions. The reverse gate actuator is controlled to: rotate the reverse gate at a first speed of rotation from the stowed position to the intermediate position; stop rotation of the reverse gate at the intermediate position for the delay; and following the delay, rotate the reverse gate at a second speed of rotation from the intermediate position to the deceleration position. The second speed of rotation is less than the first speed of rotation.

In some implementations of the present technology, controlling the reverse gate actuator to rotate the reverse gate at the first speed of rotation includes applying a first power level to the reverse gate actuator; controlling the reverse gate actuator to rotate the reverse gate at the second speed of rotation includes applying a second power level to the reverse gate actuator; and the second power level is smaller than the first power level.

In some implementations of the present technology, the first power level is independent of the actuated position of the deceleration device; and the second power level is dependent on the actuated position of the deceleration device.

In some implementations of the present technology, the first speed of rotation is independent of the actuated position of the deceleration device; and the second speed of rotation is dependent on the actuated position of the deceleration device.

In some implementations of the present technology, the reverse gate actuator is controlled to: rotate the reverse gate at a first speed of rotation from the stowed position to an intermediate position, the intermediate position being intermediate the stowed and deceleration positions; and rotate the reverse gate at a second speed of rotation from the intermediate position to the deceleration position, the second speed of rotation being less than the first speed of rotation.

In some implementations of the present technology, controlling the reverse gate actuator to rotate the reverse gate at the first speed of rotation includes applying a first power level to the reverse gate actuator; controlling the reverse gate actuator to rotate the reverse gate at the second speed of rotation includes applying a second power level to the reverse gate actuator; and the second power level is smaller than the first power level.

In some implementations of the present technology, the first power level is independent of the actuated position of the deceleration device; and the second power level is dependent on the actuated position of the deceleration device.

In some implementations of the present technology, the first speed of rotation is independent of the actuated position of the deceleration device; and the second speed of rotation is dependent on the actuated position of the deceleration device.

For purposes of this application, terms related to spatial orientation such as forwardly, rearwardly, left, and right, are as they would normally be understood by a driver of the watercraft sitting thereon in a normal driving position.

Also, for purposes of this application, the term "thrust request" should be understood to cover any request from the electronic control unit (ECU) that controls the target amount of thrust which should be generated by the jet propulsion system based on the various inputs received by the ECU. In an exemplary implementation, the target amount of thrust is a target percentage of the maximum available thrust. The thrust generated by the jet propulsion system (measured in Newton, "N") is primarily a function of the motor speed (measured in revolutions per minute, "RPM"), but is also affected by other factors such as the geometry of various components of the jet propulsion system. Since thrust is a function of motor speed, and motor speed is a function of motor torque, a thrust request can be translated into a motor speed request or a motor torque request. In implementations where the thrust request is a motor speed request, the ECU can monitor the motor speed as a feedback to determine if the target motor speed corresponding to the motor speed request has been reached. In implementations where the thrust request is a motor torque request, the ECU can monitor the motor torque as a feedback to determine if the target motor torque corresponding to the motor torque request has been reached. Any variable that can be controlled by the ECU and which can have an effect on thrust can be considered a thrust request or part of a thrust request by the ECU. For example, should the watercraft have a variable venturi, a control by the ECU of the diameter of the venturi can be considered a thrust request as it will affect thrust.

Also for purposes of this application, the term "motor speed request" means the target motor speed at which the motor should be operated based on the various inputs received by the ECU controlling the motor, and corresponding to a thrust request. For example, should the motor be operating at 2500 rpm, but based on the inputs received by the ECU, the ECU determines that the motor should operate at 4000 rpm, the motor speed request sets a target motor speed of 4000 rpm and the ECU will control the various engine systems (i.e. one or more of the ignition system, fuel injection system, throttle valve position, etc.) in order to reach that motor speed. As a result, the motor speed gradually increases until it reaches the motor speed target of 4000 rpm. The motor speed is primarily a function of the torque generated by the motor (measured in newton meters, "Nm"), but is also affected by other factors such as the load on the motor, which will vary with, for example, but not limited to, the hydrodynamic friction of the hull, the wind, the water current and the presence of cavitation in the jet propulsion system. The motor torque is, in the case of an internal combustion engine, primarily a function of the air/fuel ratio, the fuel injection and ignition timing and various other engine parameters.

In view of the above, it will be appreciated that the ECU can control the thrust generated by the jet propulsion system by varying, setting or otherwise controlling one or more of a plurality of parameters, including motor torque and motor speed. At a given load, an increase (or decrease) in the rate at which fuel and air are supplied to the motor results in an increase (or decrease) in the torque output by the motor, the motor speed and the thrust. However, whereas that change in motor torque will occur nearly instantaneously in response to a change in the thrust request, the motor speed and the thrust will take longer to change as the motor overcomes, for example but not limited to, the inertia of its moving parts.

The present application also refers to various positions of a reverse gate. A stowed position of the reverse gate is a position where the reverse gate does not interfere with a jet of water expelled from a steering nozzle of a jet propulsion system. A fully stowed position is the stowed position where the reverse gate is pivoted to its maximum upward position. A lowered position is a position where the reverse gate redirects at least some of the jet of water expelled from the steering nozzle. A fully lowered position is the lowered position where the reverse gate is pivoted to its maximum downward position. A neutral position is the lowered position where the water redirected by the reverse gate does not generate a significant forward or rearward thrust. A deceleration position is the lowered position toward which the reverse gate is moved to provide a deceleration thrust when a deceleration device is actuated by a driver of the watercraft. The deceleration position can be the fully lowered position or a position intermediate the neutral position and the fully lowered position.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

The present technology will be described with respect to a personal watercraft and a jet propelled boat. However, it should be understood that other types of watercraft are contemplated.

The general construction of a personal watercraft 10 will be described with respect to FIGS. 1 to 5. The following description relates to one way of manufacturing a personal watercraft. It should be recognized that there are other known ways of manufacturing and designing watercraft and that the present technology would encompass other known ways and designs. U.S. Pat. No. 7,124,703, issued Oct. 24, 2006, the entirety of which is incorporated herein by reference, describes one such other watercraft design.

Figure 1:
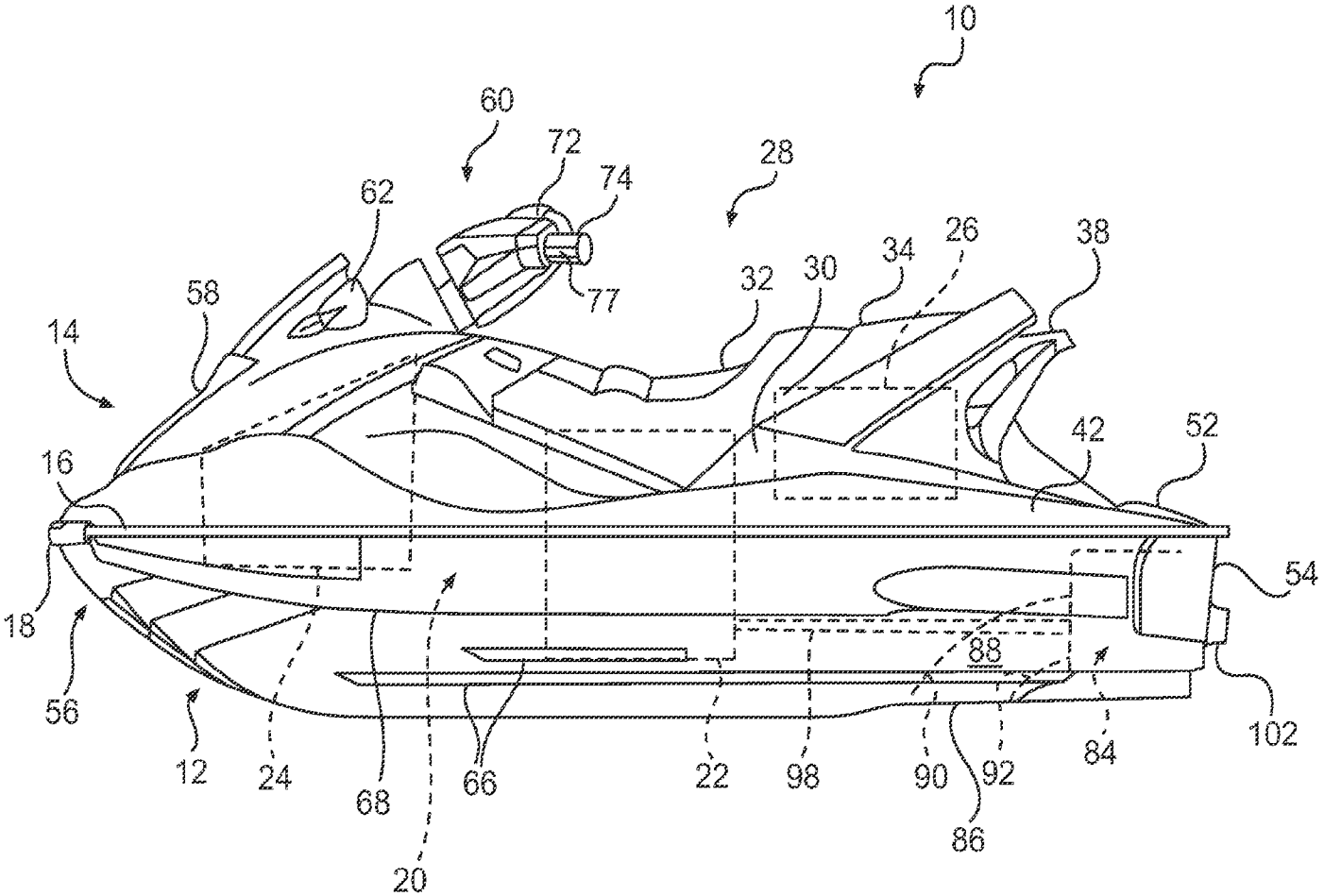
FIG. 1 is a left side elevation view of a personal watercraft.

The watercraft 10 of FIG. 1 has a hull 12 and a deck 14. The hull 12 buoyantly supports the watercraft 10 in the water. The deck 14 is designed to accommodate a driver and a passenger. The hull 12 and deck 14 are joined together at a seam 16 that joins the parts in a sealing relationship. The seam 16 comprises a bond line formed by an adhesive. Other known joining methods could be used to engage the parts together, including but not limited to, thermal fusion and fasteners such as rivets or screws. A bumper 18 generally covers the seam 16, which helps to prevent damage to the outer surface of the watercraft 10 when the watercraft 10 is docked, for example. The bumper 18 can extend around the bow 56, as shown, or around any portion or the entire seam 16.

The space between the hull 12 and the deck 14 forms a volume commonly referred to as the motor compartment 20 (shown in phantom). Shown schematically in FIG. 1, the motor compartment 20 accommodates a motor 22. In the present implementation, the motor 22 is an internal combustion engine 22. It is contemplated that the motor 22 could be any other type of motor such as an electric motor or a combination of an internal combustion engine and an electric motor. The motor compartment 20 also accommodates a muffler, tuning pipe, gas tank, electrical system (battery, electronic control unit, etc.), air box, storage bins 24, 26, and other elements required or desirable in the watercraft 10.

Figure 2:
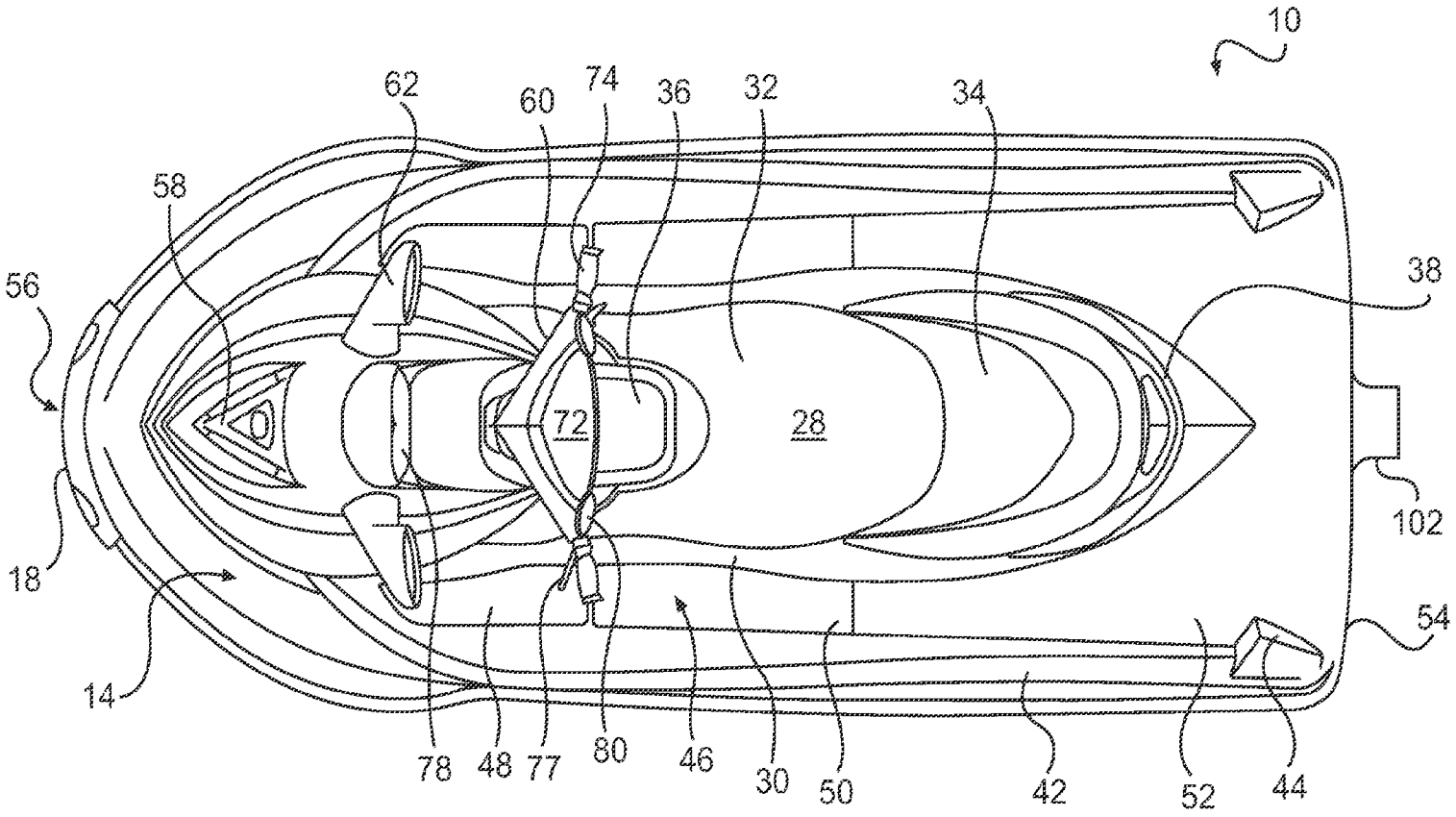
FIG. 2 is a top plan view of the watercraft of FIG. 1.

As seen in FIGS. 1 and 2, the deck 14 has a centrally positioned straddle-type seat 28 positioned on top of a pedestal 30 to accommodate the driver and the passenger in a straddling position. As seen in FIG. 2, the seat 28 includes a front seat portion 32 to accommodate the driver and a rear, raised seat portion 34 to accommodates the passenger. It is contemplated that the seat 28 could be configured to accommodate only the driver or to accommodate the driver and more than one passenger. The seat 28 is made as a cushioned or padded unit or interfitting units. The front and rear seat portions 32, 34 are removably attached to the pedestal 30 by a hook and tongue assembly (not shown) at the front of each seat portion and by a latch assembly (not shown) at the rear of each seat portion, or by any other known attachment mechanism. The seat portions 32, 34 can be individually tilted or removed completely. One of the seat portions 32, 34 covers an engine access opening (in this case above engine 22) defined by a top portion of the pedestal 30 to provide access to the engine 22 (FIG. 1). The other seat portion (in this case portion 34) covers a removable storage box 26 (FIG. 1). A small storage box 36 is provided in front of the seat 28.

Figure 4:
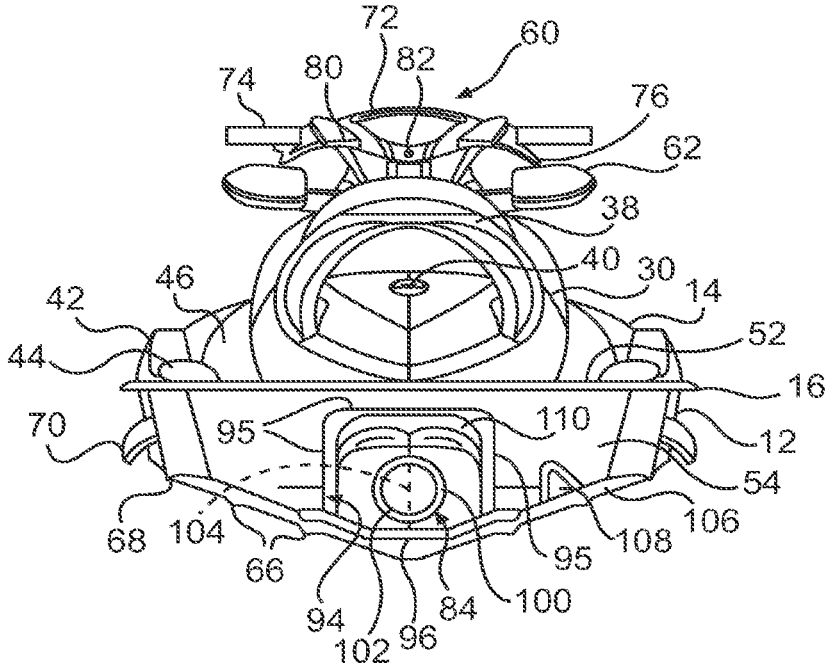
FIG. 4 is a rear elevation view of the watercraft of FIG. 1.

As seen in FIG. 4, a grab handle 38 is provided between the pedestal 30 and the rear of the seat 28 to provide a handle onto which the passenger may hold. This arrangement is particularly convenient for a passenger seated facing backwards for spotting a water skier, for example. Beneath the handle 38, a tow hook 40 is mounted on the pedestal 30. The tow hook 40 can be used for towing a skier or a floatation device, such as an inflatable water toy.

As best seen in FIGS. 2 and 4 the watercraft 10 has a pair of generally upwardly extending walls located on either side of the watercraft 10 known as gunwales or gunnels 42. The gunnels 42 help to prevent the entry of water in the footrests 46 of the watercraft 10, provide lateral support for the riders' feet, and also provide buoyancy when turning the watercraft 10, since personal watercraft roll slightly when turning. Towards the rear of the watercraft 10, the gunnels 42 extend inwardly to act as heel rests 44. Heel rests 44 allow the passenger riding the watercraft 10 facing towards the rear, to spot a water-skier for example, to place his or her heels on the heel rests 44, thereby providing a more stable riding position. The heel rests 44 could also be formed separate from the gunnels 42.

Footrests are located on both sides of the watercraft 10, between the pedestal 30 and the gunnels 42. The footrests 46 are designed to accommodate a rider's feet in various riding positions. To this effect, the footrests 46 each have a forward portion 48 angled such that the front portion of the forward portion 48 (toward the bow 56 of the watercraft 10) is higher, relative to a horizontal reference point, than the rear portion of the forward portion 48. The remaining portions of the footrests 46 are generally horizontal. It is contemplated that any contour conducive to a comfortable rest for the rider could be used. The footrests 46 are covered by carpeting 50 made of a rubber-type material, for example, to provide additional comfort and traction for the feet of the rider.

A reboarding platform 52 is provided at the rear of the watercraft 10 on the deck 14 to allow the rider or a passenger to easily reboard the watercraft 10 from the water. Carpeting or some other suitable covering covers the reboarding platform 52. A retractable ladder (not shown) may be affixed to the transom 54 to facilitate boarding the watercraft 10 from the water onto the reboarding platform 52.

Figure 3:
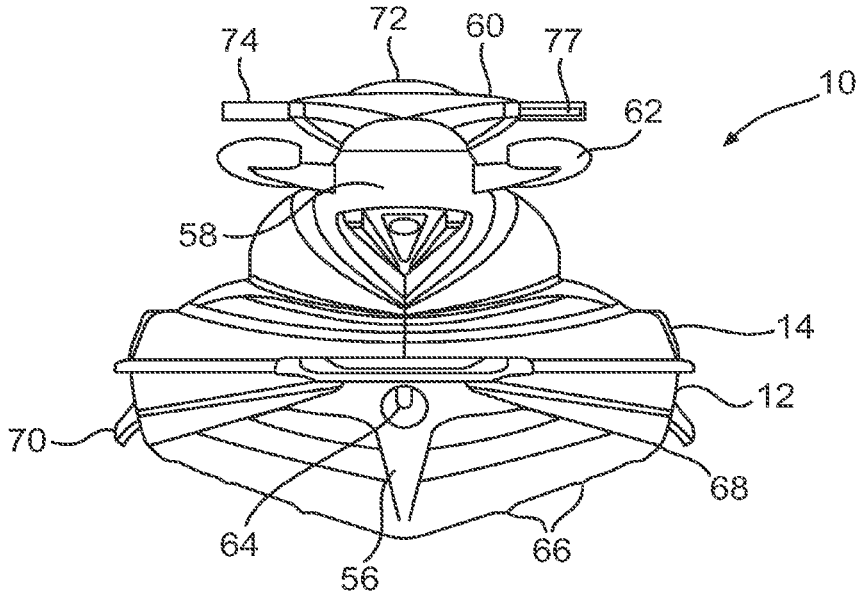
FIG. 3 is a front elevation view of the watercraft of FIG. 1.

Referring to the bow 56 of the watercraft 10, as seen in FIGS. 2 and 3, the watercraft 10 is provided with a hood 58 located forwardly of the seat 28 and a steering assembly including a helm assembly 60. A hinge (not shown) is attached between a forward portion of the hood 58 and the deck 14 to allow the hood 58 to move to an open position to provide access to the front storage bin 24 (FIG. 1). A latch (not shown) located at a rearward portion of hood 58 locks hood 58 into a closed position. When in the closed position, the hood 58 prevents water from entering front storage bin 24. Rear-view mirrors 62 are positioned on either side of hood 58 to allow the driver to see behind the watercraft 10. A hook 64 is located at the bow 56 of the watercraft 10. The hook 64 is used to attach the watercraft 10 to a dock when the watercraft 10 is not in use or to attach the watercraft 10 to a winch when loading the watercraft 10 on a trailer, for instance.

Figure 5:
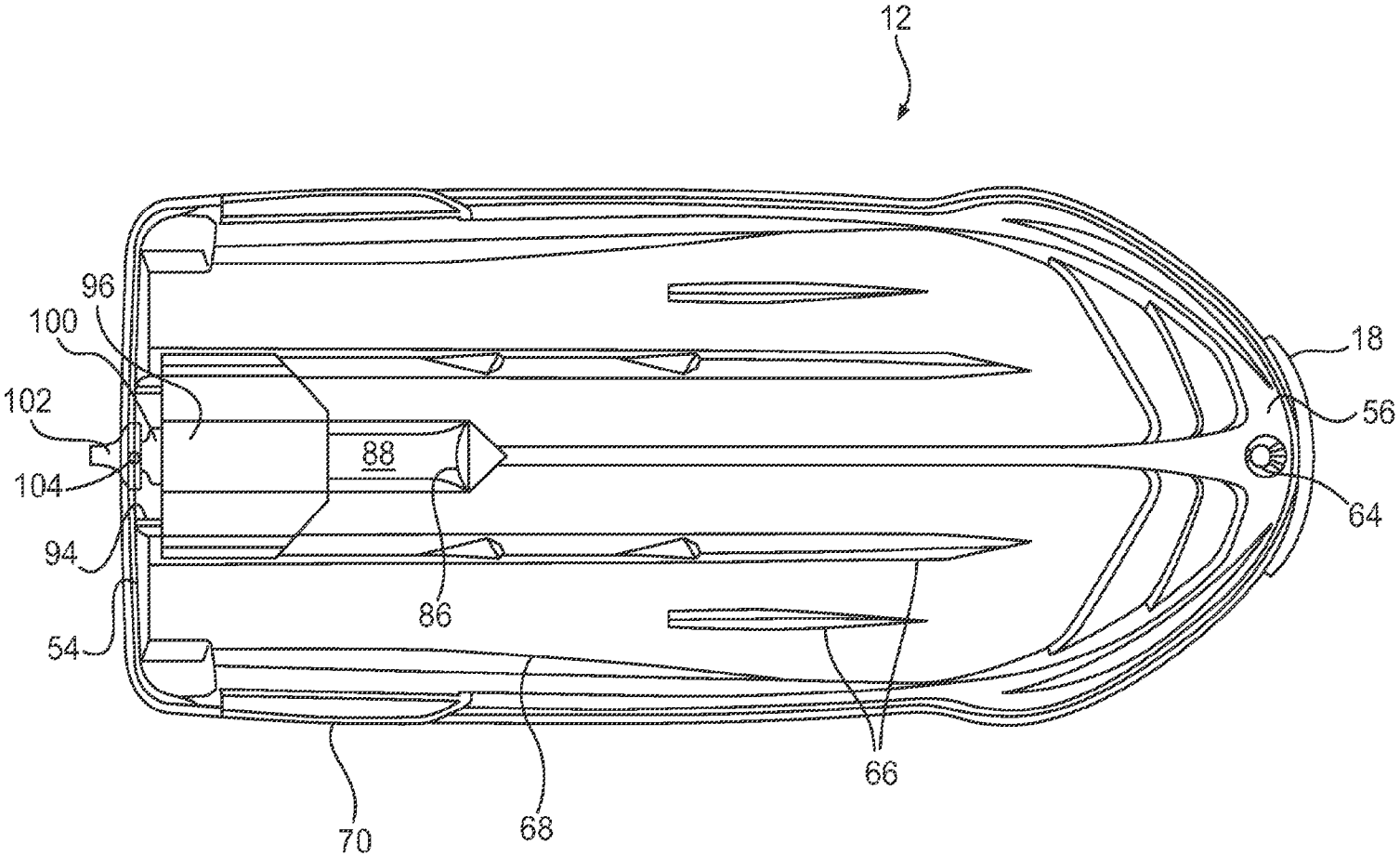
FIG. 5 is a bottom plan view of the hull of the watercraft of FIG. 1.

As best seen in FIGS. 3, 4, and 5, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 70 are located on both sides of the hull 12 near the transom 54. The sponsons 70 have an arcuate undersurface that gives the watercraft 10 both lift while in motion and improved turning characteristics. The sponsons 70 are fixed to the surface of the hull 12 and can be attached to the hull 12 by fasteners or molded therewith. It is contemplated that the position of the sponsons 70 could be adjusted with respect to the hull 12 to change the handling characteristics of the watercraft 10 and accommodate different riding conditions.

As best seen in FIGS. 3 and 4, the helm assembly 60 is positioned forwardly of the seat 28. The helm assembly 60 has a central helm portion 72, which may be padded, and a pair of steering handles 74, also referred to as a handlebar. One of the steering handles 74 is provided with a throttle operator 76, which allows the rider to control the engine 22, and therefore the speed of the watercraft 10. The throttle operator 76 can be in the form of a thumb-actuated throttle lever (as shown), a finger-actuated throttle lever, or a twist grip. The throttle operator 76 is movable between an idle position and multiple actuated positions. The throttle operator 76 is biased towards the idle position, such that when the driver of the watercraft lets go of the throttle operator 76, it will move to the idle position. The other of the steering handles 74 is provided with a deceleration device in the form of a lever 77 used by the driver to decelerate the watercraft 10 and make the watercraft 10 move in reverse as will be described in greater detail below.

As seen in FIG. 2, a display area or cluster 78 is located forwardly of the helm assembly 60. The display cluster 78 can be of any conventional display type, including a liquid crystal display (LCD), dials or LEDs (light emitting diodes). The central helm portion 72 has various buttons 80, which could alternatively be in the form of levers or switches that allow the rider to modify the display data or mode (speed, engine rpm, time . . . ) on the display cluster 78. Buttons 80 may also be used by the driver to control the jet propulsion system 84 as described in greater detail below.

The helm assembly 60 also has a key receiving post 82 (FIG. 4), located near a center of the central helm portion 72. The key receiving post 82 is configured to receive a key (not shown) that permits starting of the watercraft 10. The key is attached to a safety lanyard (not shown). It should be noted that the key receiving post 82 may be placed in any suitable location on the watercraft 10.

Returning to FIGS. 1 and 5, the watercraft 10 is generally propelled by a jet propulsion system 84. The jet propulsion system 84 pressurizes water to create thrust. The water is first scooped from under the hull 12 through an inlet 86, which has an inlet grate (not shown in detail). The inlet grate prevents large rocks, weeds, and other debris from entering the jet propulsion system 84, which may damage the system or negatively affect performance. Water flows from the inlet 86 through a water intake ramp 88. The top portion 90 of the water intake ramp 88 is formed by the hull 12, and a ride shoe (not shown in detail) forms its bottom portion 92. Alternatively, the intake ramp 88 may be a single piece or an insert to which the jet propulsion system 84 attaches. In such cases, the intake ramp 88 and the jet propulsion system 84 are attached as a unit in a recess in the bottom of hull 12.

Figure 8:
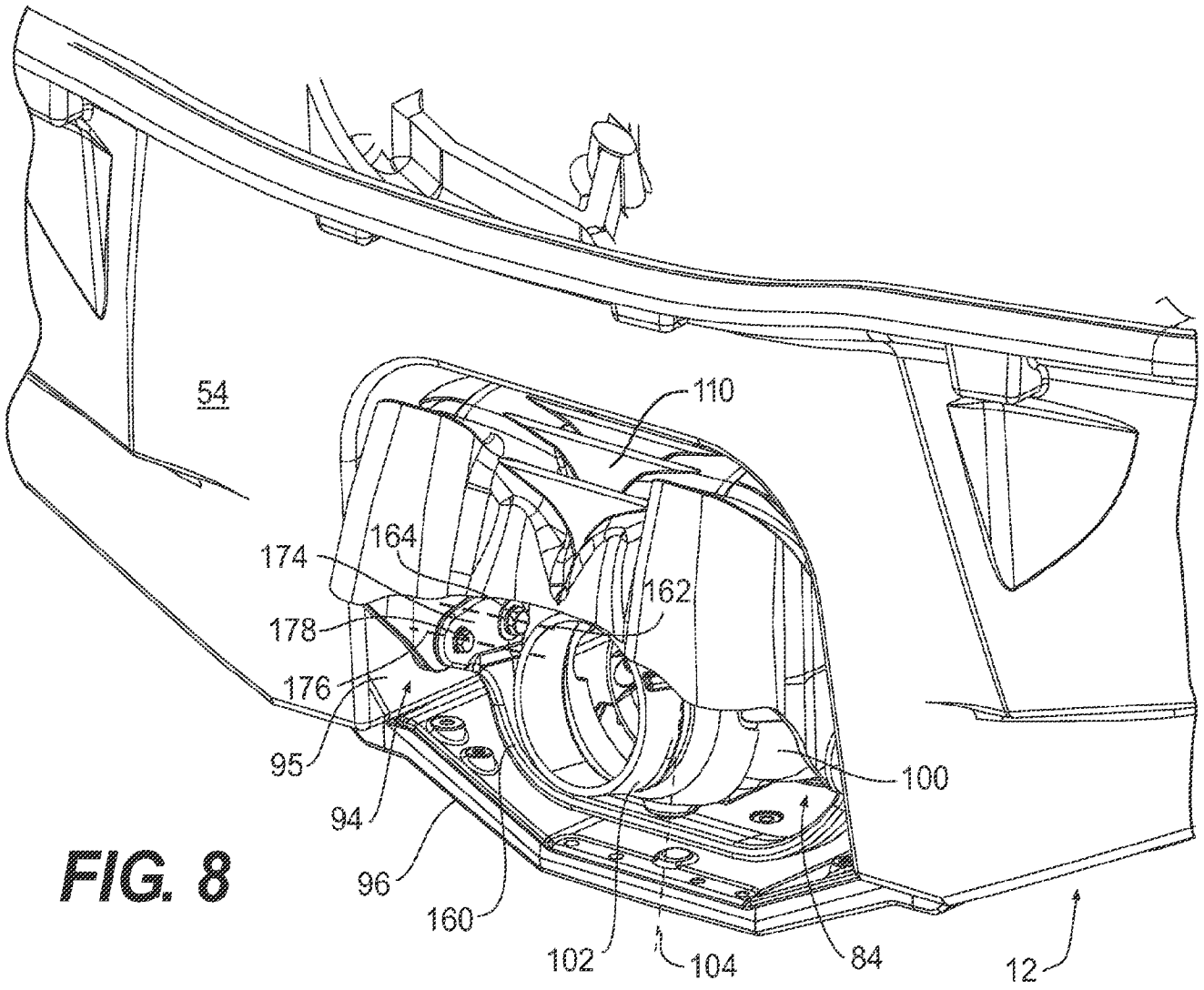
FIG. 8 is a perspective view, taken from a rear, right side, of a transom of the personal watercraft of FIG. 1.

From the intake ramp 88, water enters the jet propulsion system 84. As seen in FIG. 8, the jet propulsion system 84 is located in a formation in the hull 12, referred to as the tunnel 94. The tunnel 94 is defined at the front, sides, and top by walls 95 formed by the hull 12 (see FIG. 9) and is open at the transom 54. The bottom of the tunnel 94 is closed by a ride plate 96. The ride plate 96 creates a surface on which the watercraft 10 rides or planes at high speeds.

The jet propulsion system 84 includes a jet pump 99. The forward end of the jet pump 99 is connected to the front wall 95 of the tunnel 94. The jet pump 99 includes an impeller (not shown) and a stator (not shown). The impeller is coupled to the engine 22 by one or more shafts 98, such as a driveshaft and an impeller shaft. The rotation of the impeller pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet pump 99, it goes through a venturi 100 that is connected to the rearward end of the jet pump 99. Since the venturi's exit diameter is smaller than its entrance diameter, the water is accelerated further, thereby providing more thrust. A steering nozzle 102 is rotationally mounted relative to the venturi 100, as described in greater detail below, so as to pivot about a steering axis 104.

The steering nozzle 102 is operatively connected to the helm assembly 60 via a push-pull cable (not shown) such that when the helm assembly 60 is turned, the steering nozzle 102 pivots about the steering axis 104. This movement redirects the pressurized water coming from the venturi 100, so as to redirect the thrust and steer the watercraft 10 in the desired direction.

The jet propulsion system 84 is provided with a reverse gate 110 which is movable between a fully stowed position where it does not interfere with a jet of water being expelled by the steering nozzle 102 and a plurality of positions where it redirects the jet of water being expelled by the steering nozzle 102 as described in greater detail below. The reverse gate 110 is provided with flow vents 111 on either side thereof. When the steering nozzle 110 is in a lowered position and the steering nozzle 102 is turned left or right, a portion of the jet of water being expelled by the steering nozzle 102 flows through a corresponding one of the flow vents 111 thus creating a lateral thrust which assists in steering the watercraft 10. The specific construction of the reverse gate 110 will not be described in detail herein. It is contemplated that different types of reverse gate could be provided without departing from the present technology. One example of a suitable reverse gate is described in U.S. Pat. No. 6,533,623, issued on Mar. 18, 2003, the entirety of which is incorporated herein by reference.

When the watercraft 10 is moving, its speed is measured by a speed sensor 106 attached to the transom 54 of the watercraft 10. The speed sensor 106 has a paddle wheel 108 that is turned by the water flowing past the hull 12. In operation, as the watercraft 10 goes faster, the paddle wheel 108 turns faster in correspondence. An electronic control unit (ECU) 228 (FIG. 21) connected to the speed sensor 106 converts the rotational speed of the paddle wheel 108 to the speed of the watercraft 10 in kilometers or miles per hour, depending on the rider's preference. The speed sensor 106 may also be placed in the ride plate 96 or at any other suitable position. Other types of speed sensors, such as pitot tubes, and processing units could be used. Alternatively, a global positioning system (GPS) unit could be used to determine the speed of the watercraft 10 by calculating the change in position of the watercraft 10 over a period of time based on information obtained from the GPS unit.

Figure 6:
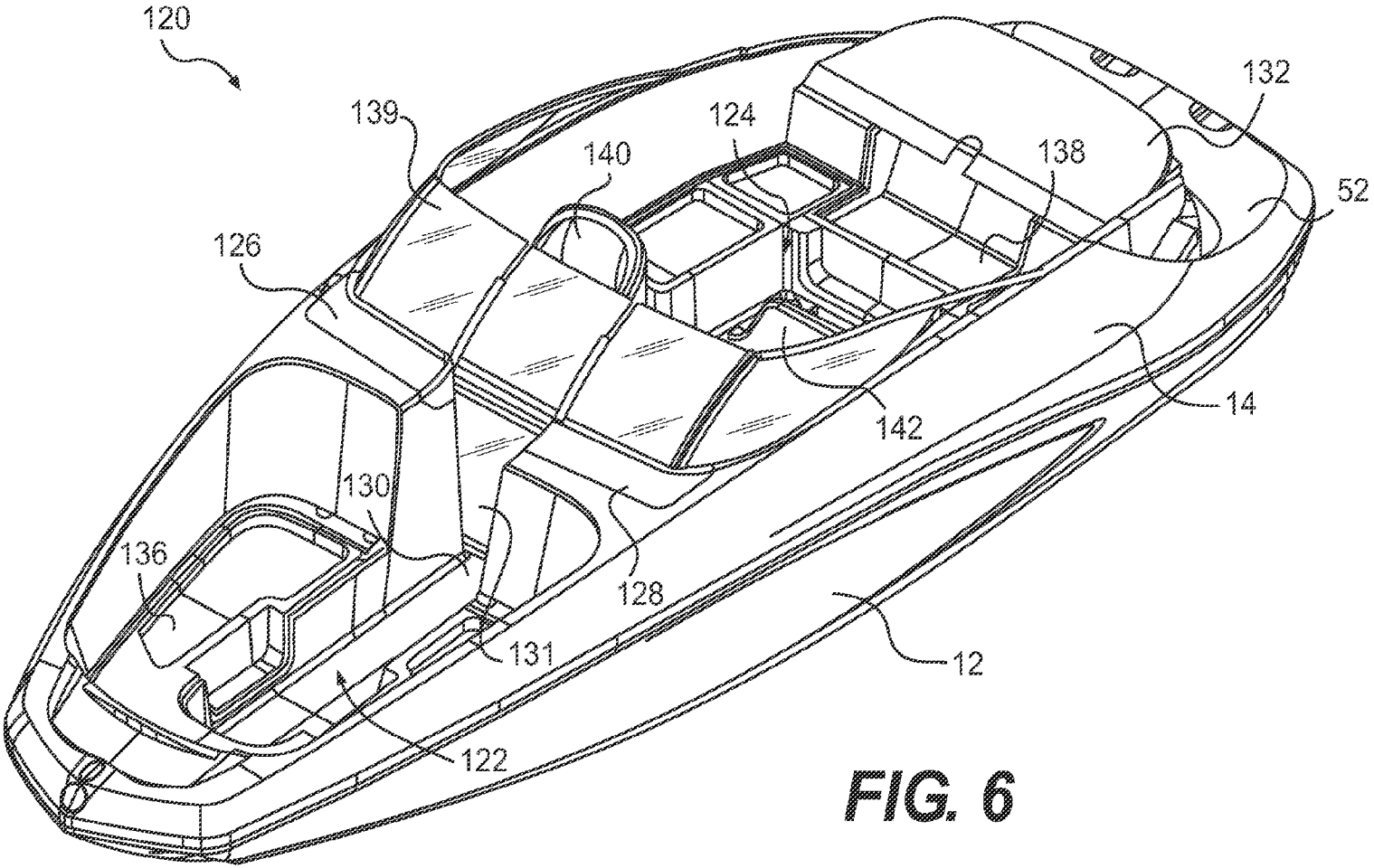
FIG. 6 is a perspective view, taken from a front, left side, of a jet propelled boat.
Figure 7:
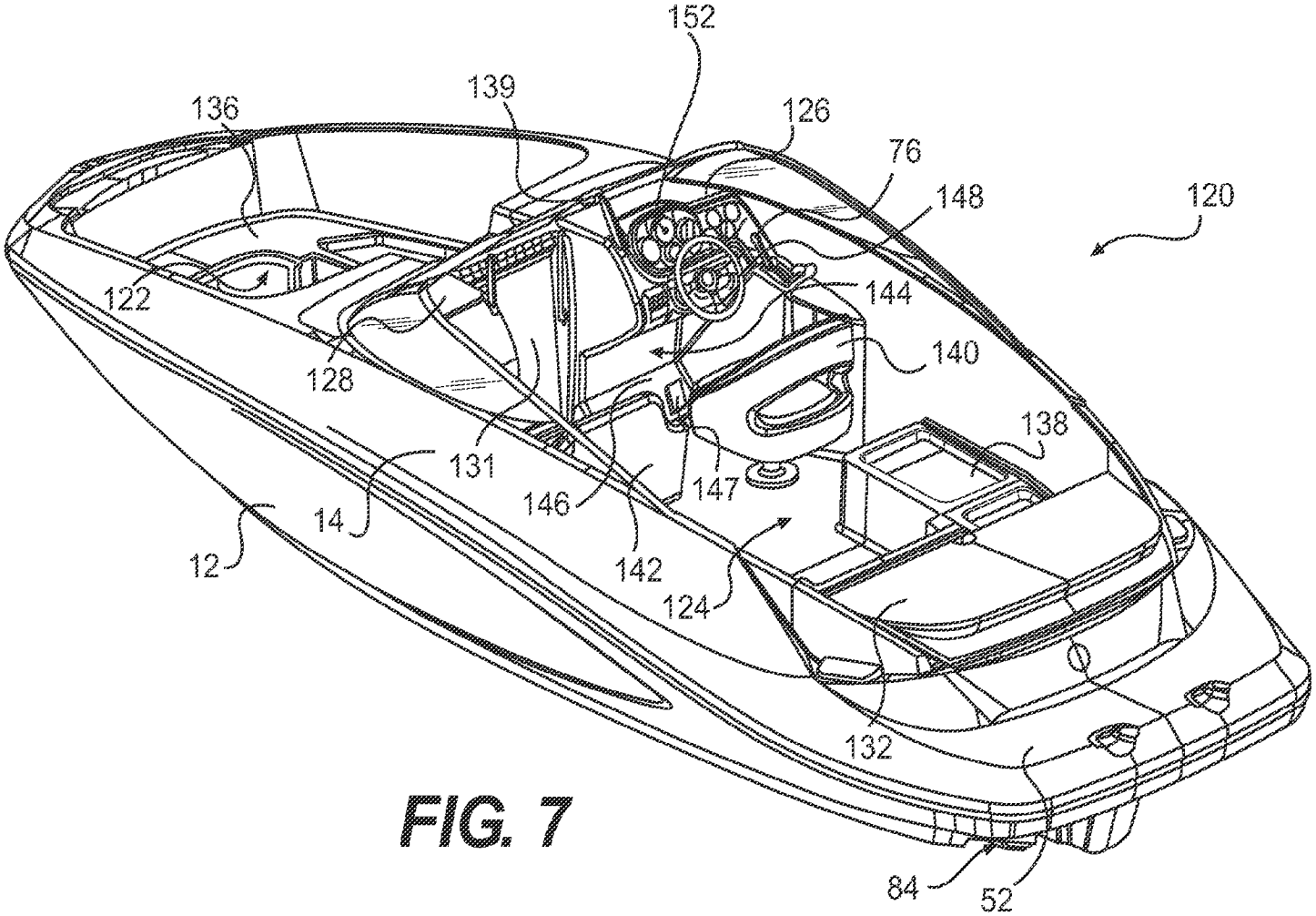
FIG. 7 is a perspective view, taken from a rear, left side, of the jet propelled boat of FIG. 6.

The general construction of a jet propelled boat 120 will now be described with respect to FIGS. 6 and 7. The following description relates to one way of manufacturing a jet propelled boat. Other known ways of manufacturing and designing jet propelled boats are contemplated.

For simplicity, the components of the jet propelled boat 120 which are similar in nature to the components of the personal watercraft 10 described above will be given the same reference numeral. Their specific construction may vary however.

The jet propelled boat 120 has a hull 12 and a deck 14 supported by the hull 12. The deck 14 has a forward passenger area 122 and a rearward passenger area 124. A right console 126 and a left console 128 are disposed on either side of the deck 14 between the two passenger areas 122, 124. A passageway 130 disposed between the two consoles 126, 128 allows for communication between the two passenger areas 122, 124. A door 131 is used to selectively open and close the passageway 130. At least one motor (not shown) is located between the hull 12 and the deck 14 at the back of the boat 120. In the present implementation, the at least one motor is at least one internal combustion engine. It is contemplated that the motor could be an electric motor or a combination of internal combustion engine and electric motor. The engine powers a jet propulsion system 84 of the boat 120. The jet propulsion system 84 is of similar construction as the jet propulsion system 84 of the personal watercraft 10 described above, and in greater detail below, and will therefore not be described in detail herein. It is contemplated that the boat 120 could have two engines and two jet propulsion systems 84. The engine is accessible through an engine cover 132 located behind the rearward passenger area 124. The engine cover 132 can also be used as a sundeck for a passenger of the boat 120 to sunbathe on while the boat 120 is not in motion. A reboarding platform 52 is located at the back of the deck 14 for passengers to easily reboard the boat 120 from the water.

The forward passenger area 122 has a C-shaped seating area 136 for passengers to sit on. The rearward passenger area 124 also has a C-shaped seating area 138 at the back thereof. A driver seat 140 facing the right console 126 and a passenger seat 142 facing the left console 124 are also disposed in the rearward passenger area 124. It is contemplated that the driver and passenger seats 140, 142 could swivel so that the passengers occupying these seats can socialize with passengers occupying the C-shaped seating area 138. A windshield 139 is provided at least partially on the left and right consoles 124, 126 and forwardly of the rearward passenger area 124 to shield the passengers sitting in that area from the wind when the boat 120 is in movement. The right and left consoles 126, 128 extend inwardly from their respective side of the boat 120. At least a portion of each of the right and the left consoles 126, 128 is integrally formed with the deck 14. The right console 126 has a recess 144 formed on the lower portion of the back thereof to accommodate the feet of the driver sitting in the driver seat 140 and an angled portion of the right console 126 acts as a footrest 146. A deceleration device in the form of a foot pedal 147 is provided on the footrest 146 which is used to control the jet propulsion system 84 as described in greater detail below. The left console 128 has a similar recess (not shown) to accommodate the feet of the passenger sitting in the passenger seat 142. The right console 126 accommodates all of the elements necessary to the driver to operate the boat 120. These include, but are not limited to: a steering assembly including a steering wheel 148, a throttle operator 76 in the form of a throttle lever, and an instrument panel 152. The instrument panel 152 has various dials indicating the watercraft speed, motor speed, fuel and oil level, and engine temperature. The speed of the watercraft is measured by a speed sensor (not shown) which can be in the form of the speed sensor 106 described above with respect to the personal watercraft 10 or a GPS unit or any other type of speed sensor which could be used for marine applications. It is contemplated that the elements attached to the right console 126 could be different than those mentioned above. The left console 128 incorporates a storage compartment (not shown) which is accessible to the passenger sitting the passenger seat 142.

Turning now to FIGS. 8 to 20 the jet propulsion system 84 will be described. The jet propulsion system 84 being described is only one possible type of jet propulsion system and other types of jet propulsion systems are contemplated that would be encompassed by the present technology. As seen in FIG. 8, the jet propulsion system 84 is disposed in the tunnel 94 of the watercraft 10. It is contemplated that the jet propulsion system 84 could be mounted directly to the transom 54.

Figure 12:
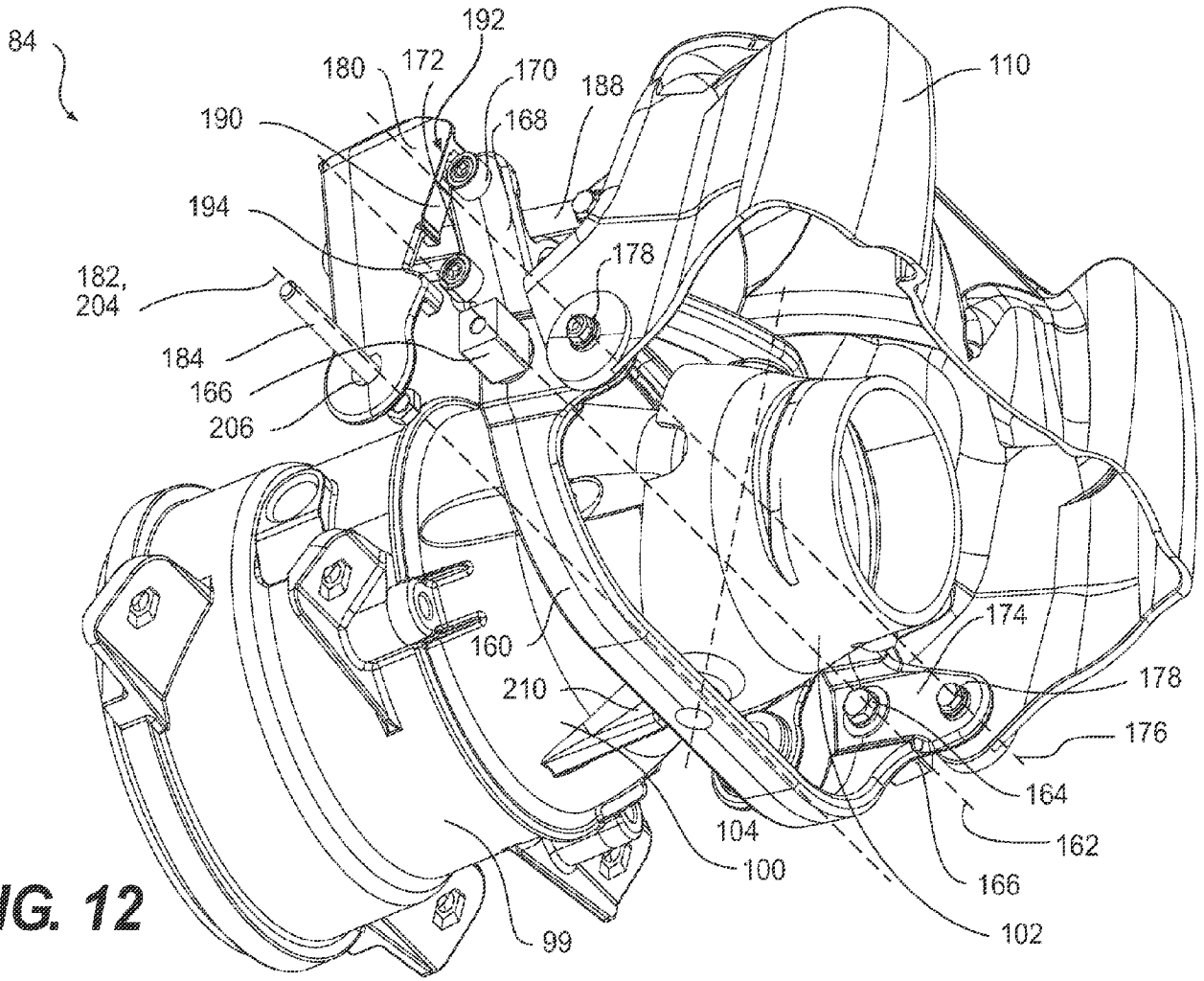
FIG. 12 is a bottom perspective view, taken from a rear, left side, of the jet propulsion system of FIG. 10 with the reverse gate in the stowed position.
Figure 13:
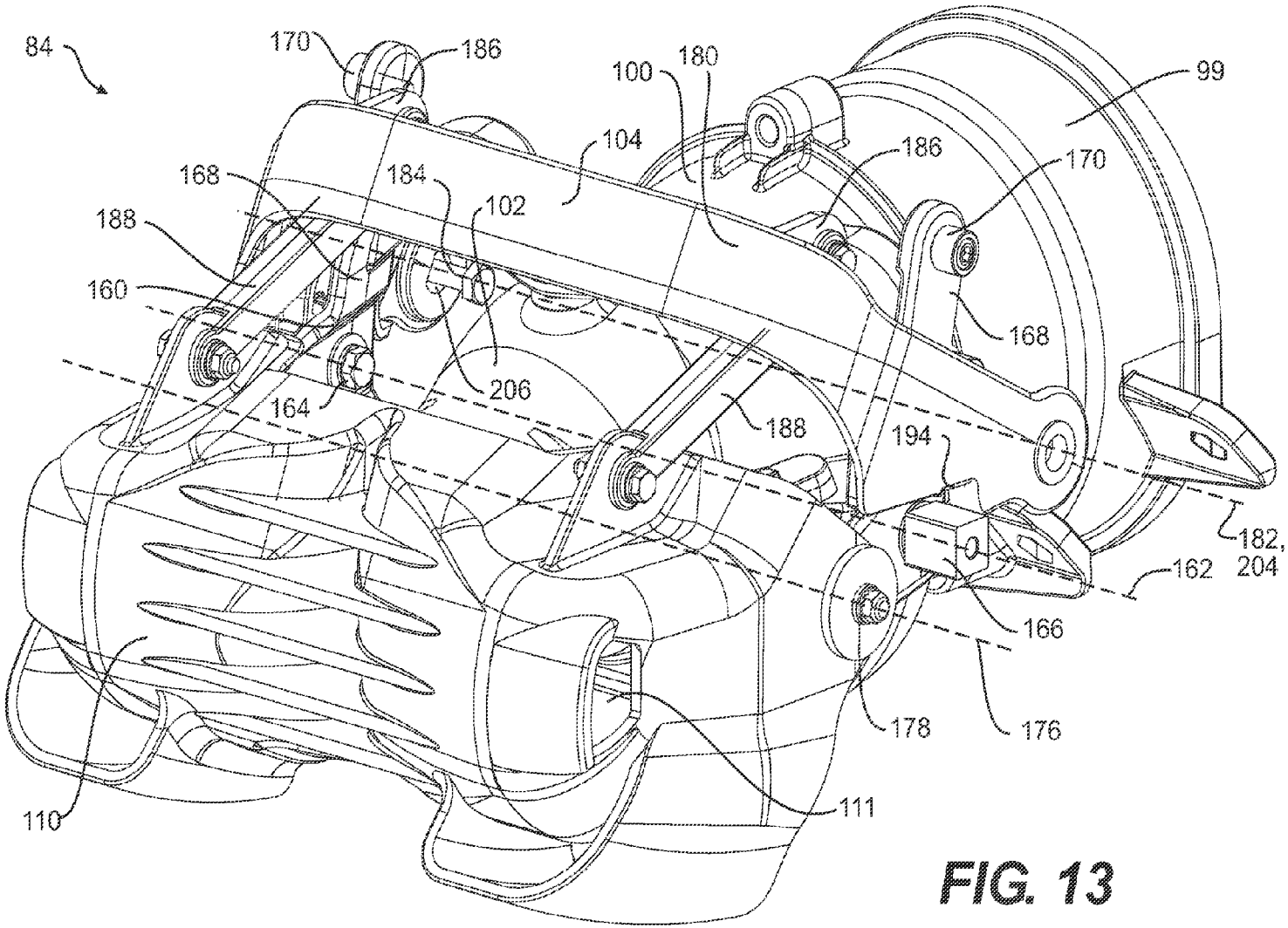
FIG. 13 is a perspective view, taken from a rear, right side, of the jet propulsion system of FIG. 10 with the reverse gate in a fully lowered position.

As previously mentioned, the jet propulsion assembly 84 includes a jet pump 99, a venturi 100, a steering nozzle 102, and a reverse gate 110. A variable trim system (VTS) support 160 is rotationally mounted to two side plates 161 (FIG. 11) which are mounted to the two side walls 95 of the tunnel 94 (see FIG. 8) about a VTS axis 162. The VTS axis 162 extends generally laterally and horizontally. Bolts 164 are used to connect the VTS support 160 to the side plates 161. Spacer blocks 166 are provided between the VTS support 160 and the side plates 161 to prevent the VTS support 160 from moving laterally inside the tunnel 94. The right side plate 161 has an exhaust connector 163 which connects to the exhaust system (not shown) of the watercraft to allow the exhaust gases to be exhausted inside the tunnel 94. It is contemplated that the VTS support 160 could be rotationally mounted about the VTS axis 162 directly on the venturi 100. As best seen in FIG. 12, the VTS support 160 is in the shape of a ring which encircles the forward portion of the steering nozzle 102. The steering nozzle 102 is rotationally mounted at a top and bottom of the VTS support 160 about the steering axis 104 such that the steering nozzle 102 rotates with the VTS support 160 about the VTS axis 162 as described below. The steering axis 104 is generally perpendicular to the VTS axis 162. As seen in FIGS. 10 to 20, the VTS support 160 has a pair of upwardly extending arms 168. A first guide pin 170 is disposed on each of the arms 168 at a position vertically higher than the VTS axis 162. A second guide pin 172 is disposed on each of the arms 168 at a position vertically higher than the VTS axis 162 and vertically lower than the first guide pin 170. The function of guide pins 170, 172 will be described below. The VTS support 160 also has a pair of rearwardly extending arms 174 to which the reverse gate 110 is rotationally mounted about a reverse gate axis 176 by nuts and bolts 178. The reverse gate axis 176 extends generally laterally and horizontally, and is disposed rearwardly of the VTS axis 162.

Figure 10:
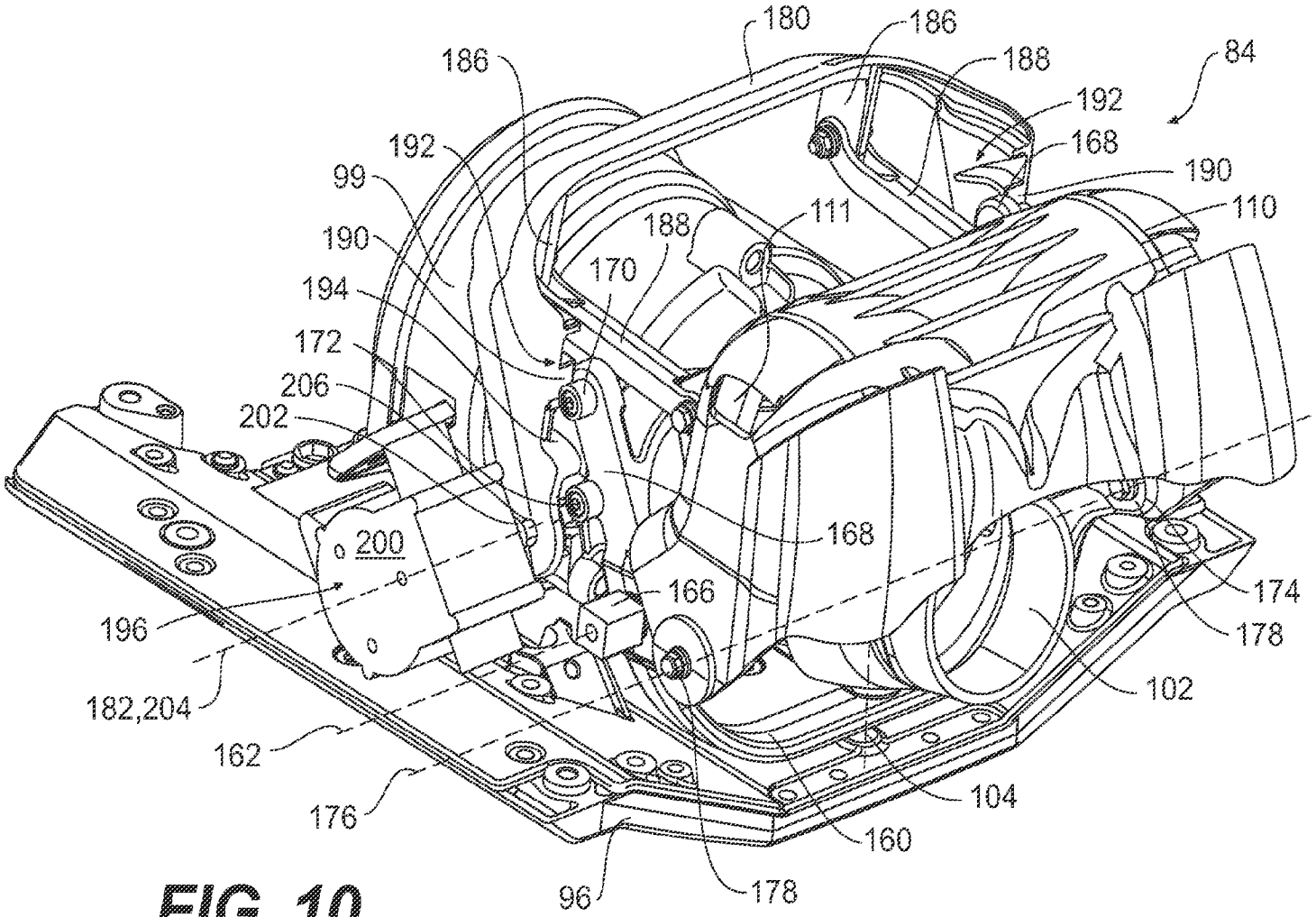
FIG. 10 is a perspective view, taken from a rear, left side, of a jet propulsion system with a reverse gate in a stowed position.
Figure 11:
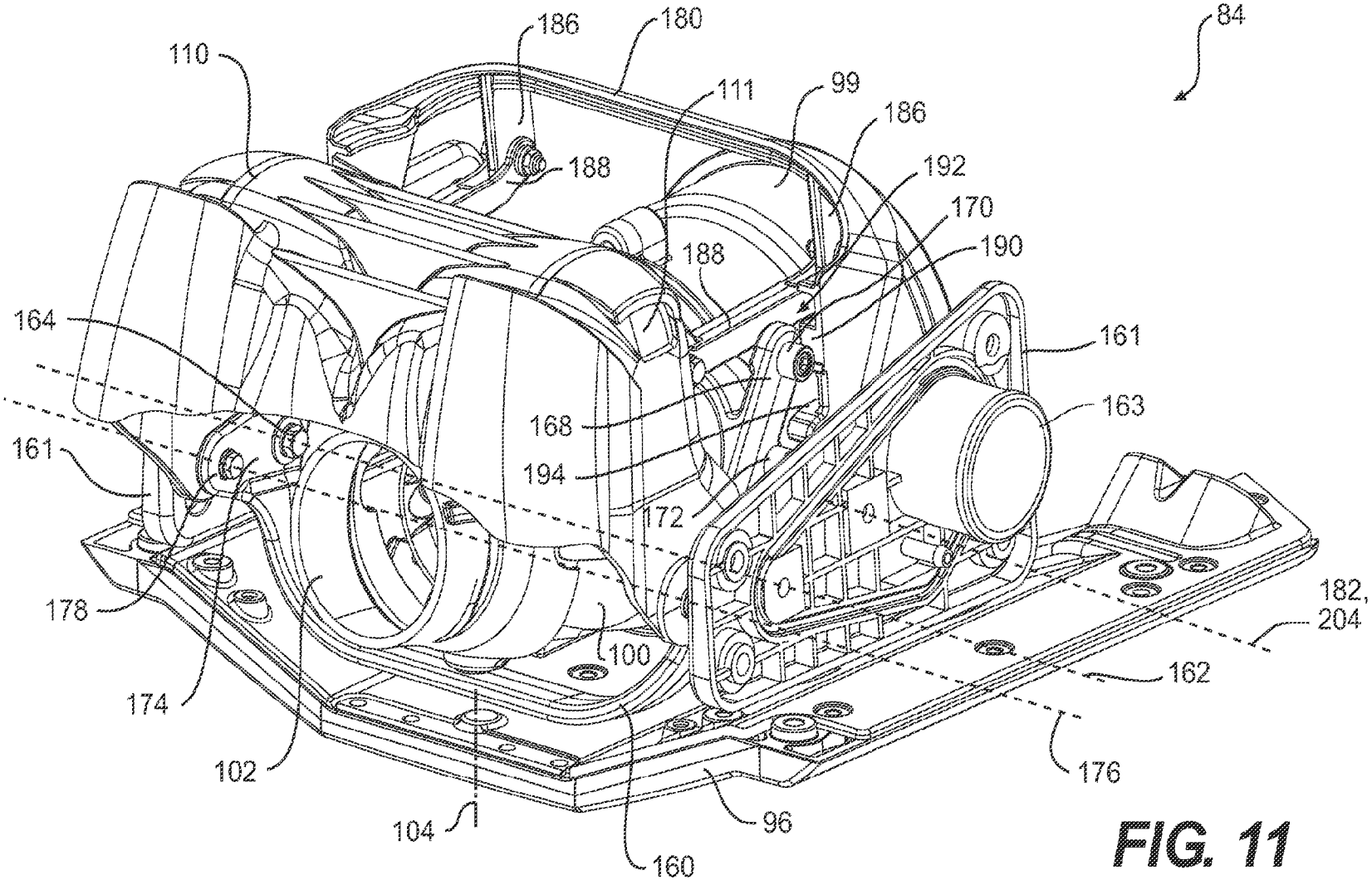
FIG. 11 is a perspective view, taken from a rear, right side, of the jet propulsion system of FIG. 10 with the reverse gate in the stowed position.

The jet propulsion system 84 is also provided with a main support 180 that is rotationally mounted to the two side plates 161 (FIG. 11) about a main support axis 182. The main support axis 182 extends generally laterally and horizontally. Bolts 184 (FIG. 12) are used to connect the main support 180 to the right side plate 161 and to the rotary actuator 196 (described below). The main support axis 182 is disposed forwardly of the VTS axis 162. It is contemplated that the main support 180 could be rotationally mounted about the main support axis 182 directly on the jet pump 99 or venturi 100. The main support 180 has an inverted U-shape. The upper portion of the main support 180 has a pair of downwardly extending tabs 186. Each tab 186 is pivotally connected to a first portion of a link 188 with a nut and a bolt. The second, opposite, portion of each link 188 is pivotally connected to the reverse gate 110 at a point vertically higher than the reverse gate axis 176 with a nut and a bolt. It is contemplated that only one or more than two tabs 186 and links 188 could be used. As best seen in FIG. 10, the main support 180 defines contact surfaces 190 on a rearwardly facing side thereof. As described in greater detail below, the first guide pins 170 contact the contact surfaces 190 in at least some arrangements of the VTS support 160 and the main support 180. As seen in FIGS. 10 and 17 to 20, the main support 180 also defines slots 192 therein which have an opening at an upper end of the contact surfaces 190. As described in greater detail below, the first guide pins 170 are disposed in the slots 192 in at least some arrangements of the VTS support 160 and the main support 180. As also seen in FIGS. 10 and 17 to 20, the main support 180 also defines ramps 194 which are disposed vertically below the slots 192 when the main support 180 is in the position shown in FIG. 17. The ramps 194 have an arcuate surface corresponding to a segment of a circle having the main support axis 182 as a center. As described in greater detail below, the second guide pins 172 contact the arcuate surfaces of the ramps 194 in at least some arrangements of the VTS support 160 and the main support 180.

Figure 9:
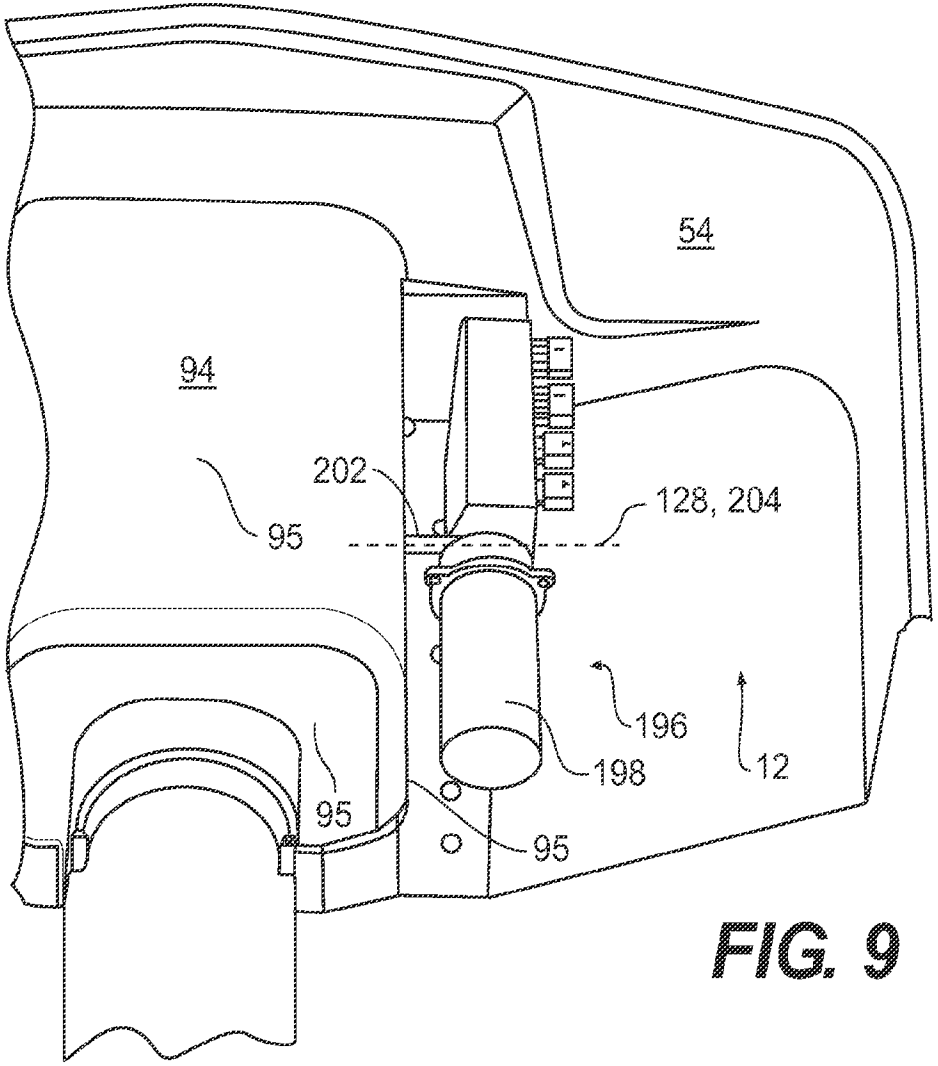
FIG. 9 is a top perspective view of a rear portion of the hull of the personal watercraft of FIG. 1.

As seen in FIGS. 9 and 10, the jet propulsion system 84 is provided with a reverse gate actuator in the form of a rotary actuator 196 disposed inside the hull 12 adjacent the left side wall 95 of the tunnel 94, thus limiting the exposure of the actuator 196 to water. The rotary actuator 196 includes a rotary electric motor 198 connected to a gear box 200 having an output portion 202. The gear box 200 transfers the rotation from an output shaft (not shown) of the rotary electric motor 198 to the output portion 202 which is perpendicular to the output shaft. It is contemplated that a power screw could be used to transfer the rotation from the output shaft of the rotary electric motor 198 to the output portion 202. It is also contemplated that a linear actuator could be used to actuate the reverse gate 110. The linear actuator could be mounted to the side wall 95 for example. The output portion 202 passes through the left side wall 95 and left side plate 161 and connects to the main support 180 so as to rotate the main support 180 about the main support axis 182 as described in greater detail below. The axis of rotation 204 of the output portion 202 is coaxial with the main support axis 182. The end of the output portion 202 has a flat part and fits inside a hole 206 in the main support 180 having a corresponding flat part so as to prevent relative rotation between the output portion 202 and the main support 180. It is contemplated that other ways of preventing relative rotation between the output portion 202 and the main support 180 could be used. It is also contemplated that other types of reverse gate actuators could be used, such as, for example, a hydraulic actuator. The rotary actuator 196 is controlled based on signals received from the ECU 228 as will be described below. The ECU 228 controls the power level applied to the rotary electric motor 198 of the rotary actuator 196. The rotary electric motor 198 rotates the output portion 202 faster as the power level applied increases. As the speed of rotation of the reverse gate 110 is proportional to the speed of rotation of the output portion 202, the speed of rotation of the reverse gate 110 increases as the power level applied to the rotary actuator 196 increases. In the present implementation, the signal supplied by the ECU 228 to the rotary actuator 196 to apply the power level is a pulse-width modulated signal resulting from a switch rapidly turning power on an off which results in an average power level between 0 and 100%. In the examples provided further below, the power level is expressed in terms of a percentage of pulse-width modulation (% PWM) that indicates the percentage of time during which power, and more specifically voltage, is applied over the period of the signal. For example, a power level of 40% PWM indicates that power is applied 40% of the time. Therefore, the higher the % PWM, the faster the reverse gate 110 rotates. It is contemplated that other methods could be used to control the power level applied to the rotary actuator 196, such as, but not limited to, controlling a current level supplied to the rotary electric motor 198 of the rotary actuator 196.

Turning now to FIGS. 14 to 20, the operation of the jet propulsion system 84, and more specifically the movement of the main support 180, VTS support 160, steering nozzle 102, and reverse gate 110, will be described. FIGS. 14 to 20 only show some of the arrangements of these components and arrangements intermediate those shown are possible. For simplicity, the description will be made only with respect to the left side of the jet propulsion system 84. Although not specifically shown in these figures, a position of the output portion 202 of the rotary actuator 196 corresponds to a position of the main support 180. As such, when the main support 180 is shown as having been rotated by a certain number of degrees in one direction from one position to another, this rotation has been caused by the output portion 202 rotating by the same number of degrees in the same direction.

Figure 14:
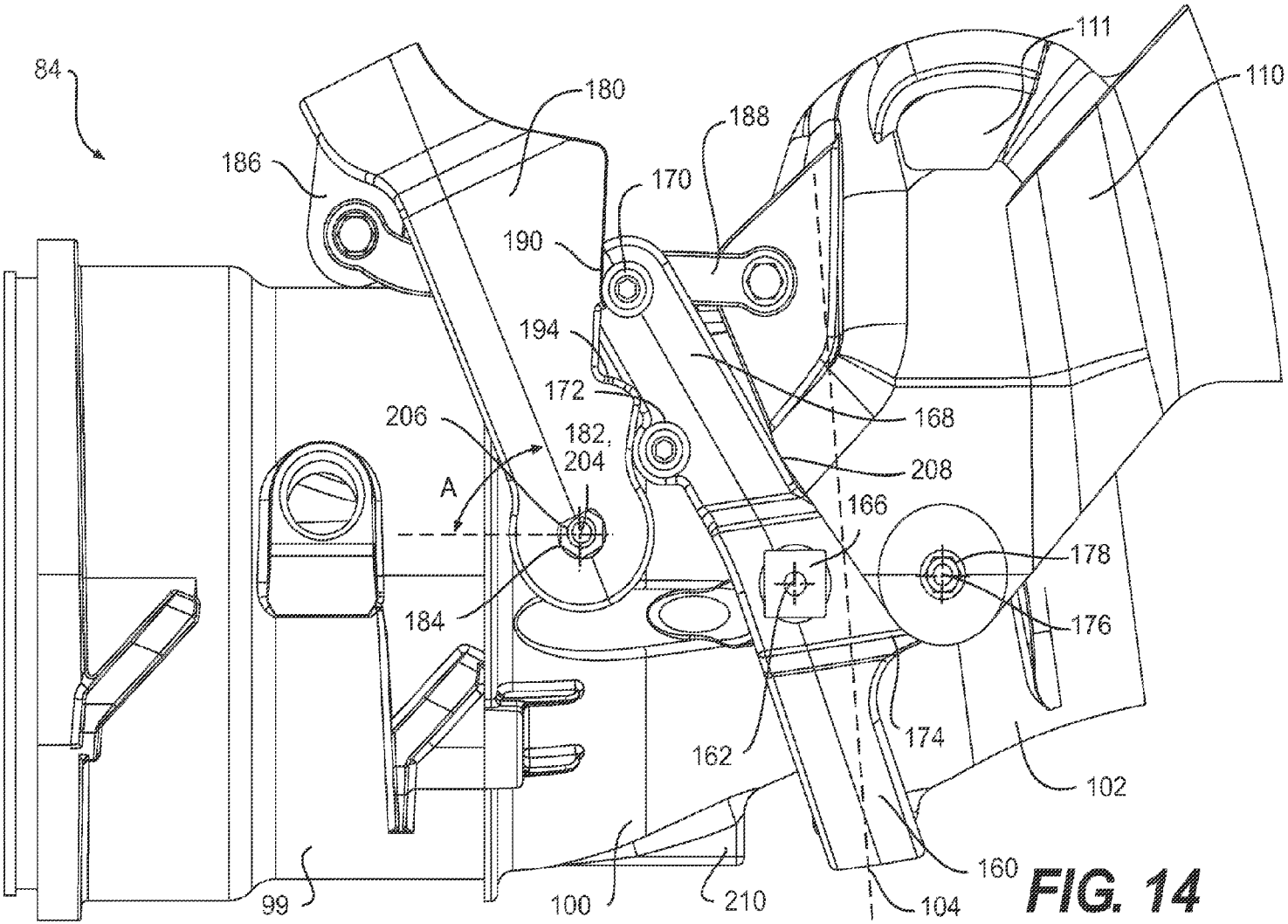
FIG. 14 is a left side view of the jet propulsion system of FIG. 10 with the variable trim system (VTS) in a VTS up position and the reverse gate in a fully stowed position.

In the arrangement shown in FIG. 14, the main support 180 is in a first position that is at an angle A from horizontal. The VTS support 160 is in a VTS up position where the steering nozzle 102 directs a jet of water from the venturi 100 slightly upwardly. The reverse gate 110 is in a fully stowed position. Unless the main support 180 is rotated by the output portion 202, the VTS support 160 is prevented from rotating counter-clockwise since the first guide pin 170 contacts the contact surface 190 and is prevented from rotating clockwise since the reverse gate 110 contacts a contact point 208 located vertically higher than the VTS axis 162 on the arm 168 of the VTS support 160. The reverse gate 110 is prevented from rotating clockwise by link 188.

Figure 15:
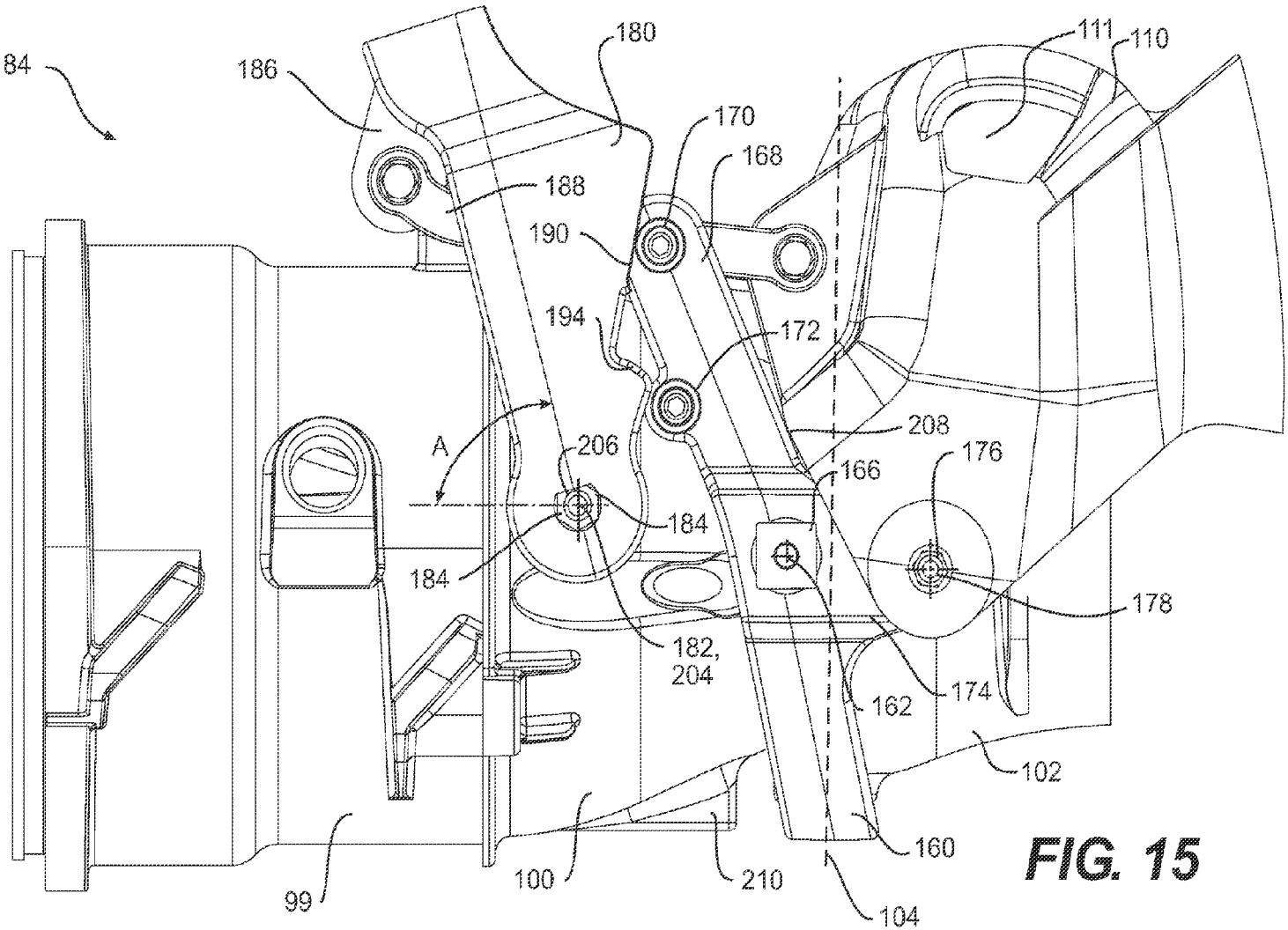
FIG. 15 is a left side view of the jet propulsion system of FIG. 10 with the VTS in a VTS neutral position and the reverse gate in a stowed position.
Figure 16:
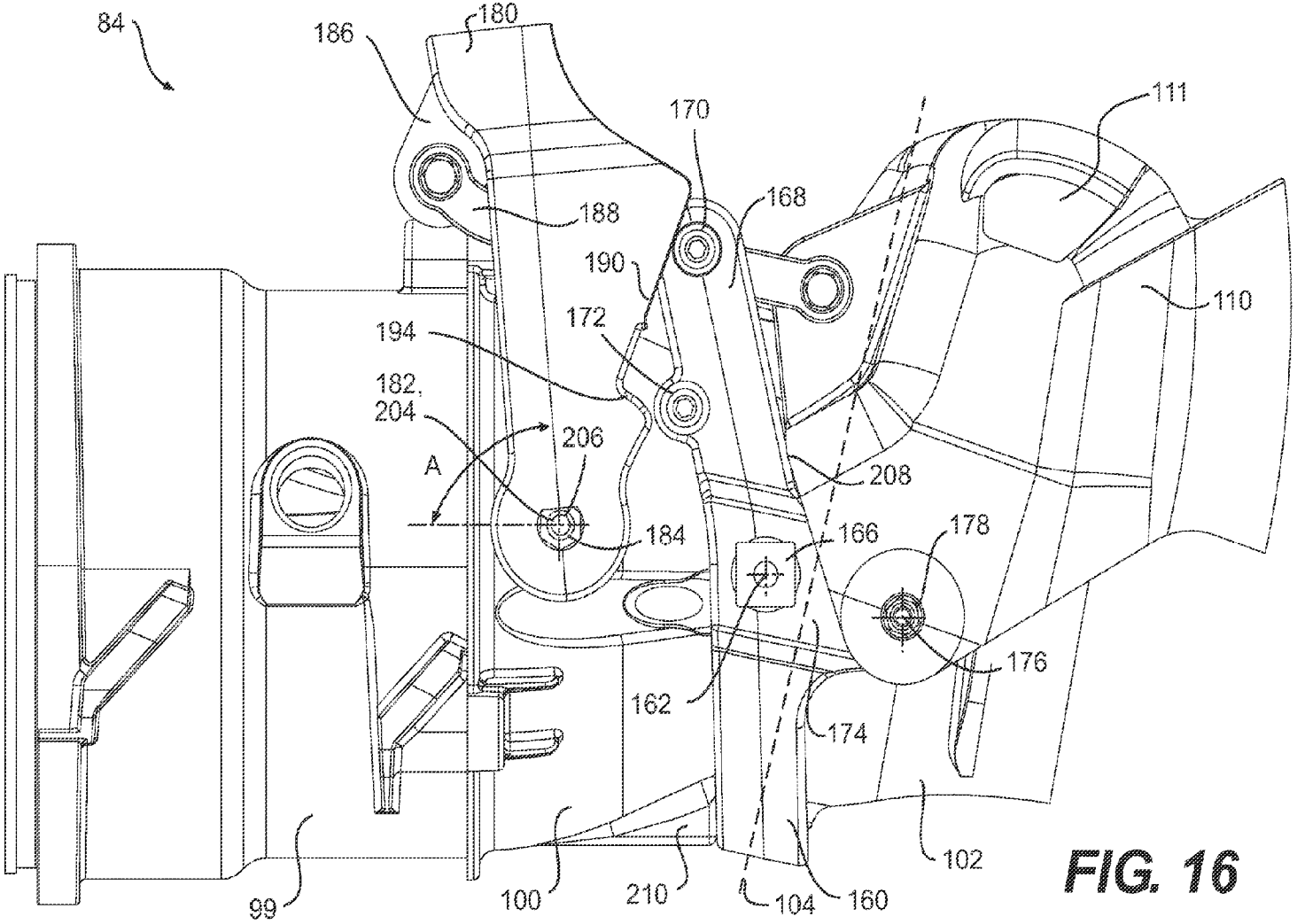
FIG. 16 is a left side view of the jet propulsion system of FIG. 10 with the VTS in a VTS down position and the reverse gate in a stowed position.
Figure 17:
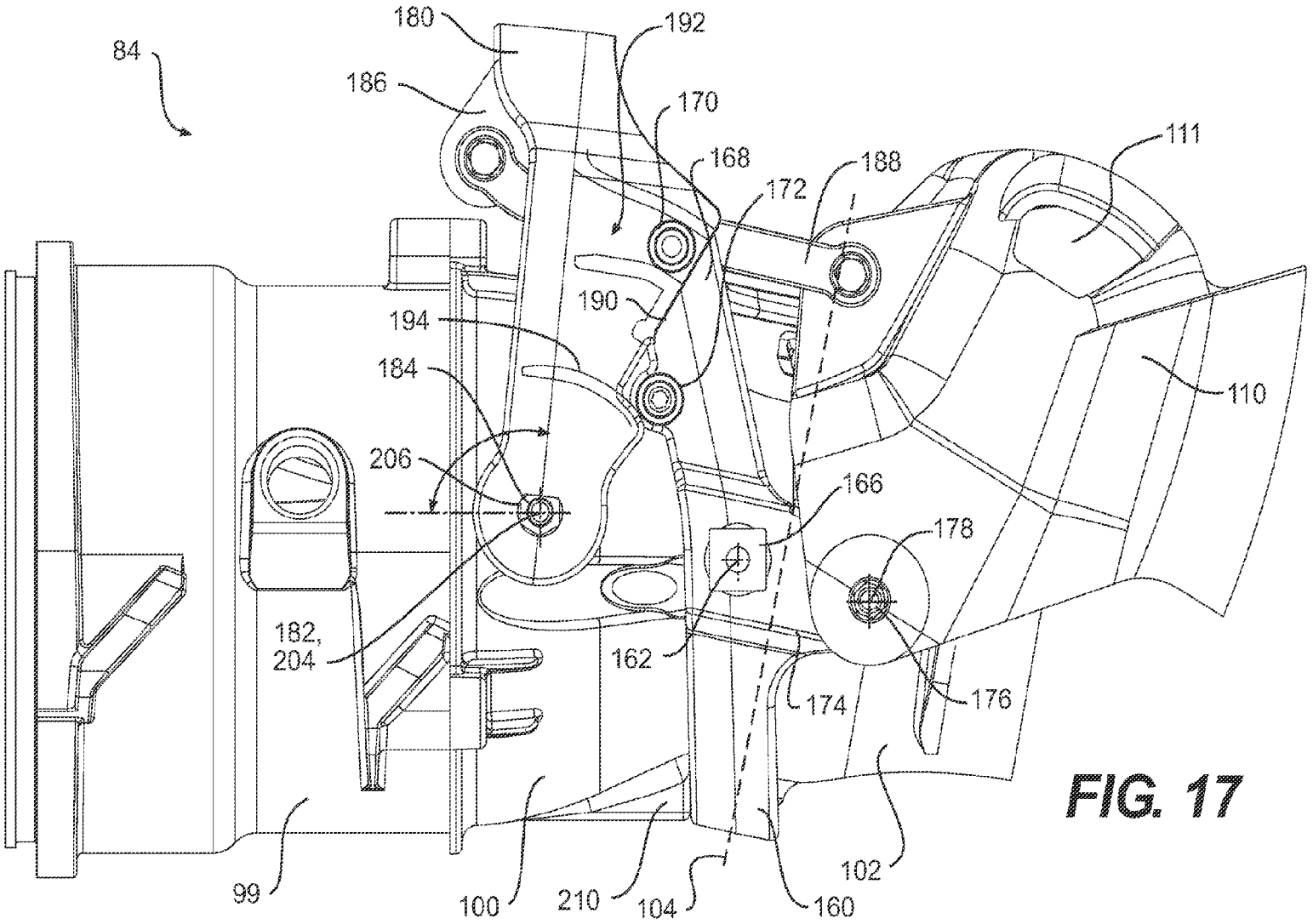
FIG. 17 is a left side view of the jet propulsion system of FIG. 10 with the VTS in a VTS down position and the reverse gate in a lowered position.

As the output portion 202 is rotated clockwise, the main support 180 also rotates clockwise about the main support axis 182 from the position shown in FIG. 14 to the position shown in FIG. 15, and then to the position shown in FIG. 16, and as such the angle A increases. As the main support 180 rotates, the guide pin 170 slides upwardly along the contact surface 190, causing the VTS support 160 to rotate clockwise about the VTS axis 162. As the VTS support 160 rotates clockwise from the position shown in FIG. 14 to the position shown in FIG. 16, the reverse gate axis 176, and therefore the reverse gate 110, moves in an arc about the VTS axis 162. As such, the position of the reverse gate 110 relative to the VTS support 160 remains substantially the same (i.e. a stowed position) and the reverse gate 110 continues to contact the contact point 208. Therefore, for each position of the main support 180 between the position shown in FIG. 14 and the position shown in FIG. 16 there is a single corresponding position of the VTS support 160 since the VTS support is held between the contact surface 190 (by first guide pin 170) and the reverse gate 110. In the arrangement shown in FIG. 15, the VTS support 160 is in a VTS neutral position where the steering nozzle 102 directs a jet of water from the venturi 100 generally parallel to the central axis of the venturi 100, and the reverse gate 110 is in a stowed position. In the arrangement shown in FIG. 16, the VTS support 160 is in a VTS down position where the steering nozzle 102 directs a jet of water from the venturi 100 slightly downwardly, and the reverse gate 110 is in a stowed position.

As the output portion 202 continues to be rotated clockwise, the main support 180 also continues to rotate clockwise about the main support axis 182 from the position shown in FIG. 16 to the positions shown in FIGS. 17 to 20 consecutively, and as such the angle A continues to increase. Since, as shown in FIGS. 16 to 20, the bottom portion of the VTS support 160 contacts a stopper portion 210 of the venturi 100, to permit the continued rotation of the main support 180 the first guide pin 170 enters slot 192. The VTS support 160 is maintained in the VTS down position in the arrangements shown in FIGS. 17 to 20 by having the second guide pin 172 contact the arcuate surface of the ramp 194, thus preventing counter-clockwise rotation of the VTS support 160 about the VTS axis 162, which would otherwise occur due to the force of the water jet on the steering nozzle 102. Since the VTS support 160 is maintained in the VTS down position, the reverse gate axis 176 remains in position. Therefore, as the main support 180 is rotated clockwise, the link 188 pushes on the reverse gate 110 which no longer contacts the contact point 208 and rotates about the reverse gate axis 176 to the positions shown in FIGS. 17 to 20 consecutively. In the positions shown in these figures, the reverse gate 110 redirects the jet of water expelled from the steering nozzle 102. In the position shown in FIG. 18, the reverse gate 110 is in a neutral position and the jet of water is redirected generally downwardly and as such the jet of water does not thrust the watercraft forward or backward. In the position shown in FIG. 20, most of the jet of water is redirected towards a front of the watercraft which causes the watercraft to decelerate or move in the reverse direction.

In summary, as the output portion 202 of the rotary actuator 196 rotates the main support 180 from the position shown in FIG. 14 to the position shown in FIG. 16, the VTS support 160 rotates from the VTS up position to the VTS down position, while the reverse gate 110 remains in the stowed position. As the output portion 202 of the rotary actuator 196 continues to rotate the main support 180 from the position shown in FIG. 16 to the position shown in FIG. 20, the reverse gate 110 rotates about the reverse gate axis 176 to redirect the jet of water being expelled from the steering nozzle 102, while the VTS support 160 remains in the VTS down position.

Figure 20:
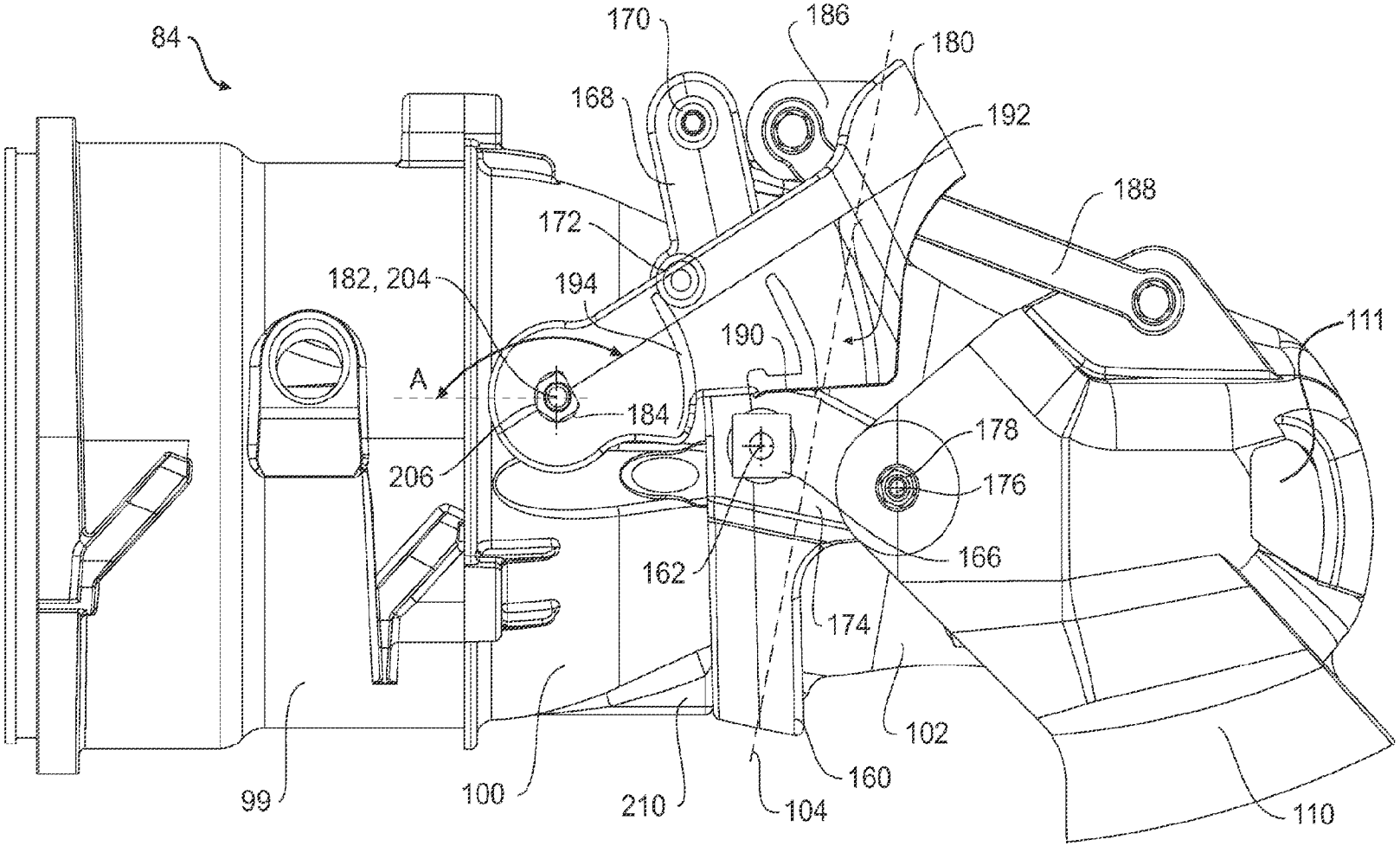
FIG. 20 is a left side view of the jet propulsion system of FIG. 10 with the VTS in a VTS down position and the reverse gate in a fully lowered position.

From FIG. 20, when the output portion 202 rotates counter-clockwise, the main support 180 rotates counter-clockwise, the link 188 pulls on the reverse gate 110 causing it to rotate counter-clockwise about the reverse gate axis 176, and the VTS support 106 remains fixed in the VTS down position until the position shown in FIG. 16. As the output portion 202 continues to rotate counter-clockwise from the position shown in FIG. 16, the reverse gate 110 contacts the contact point 208 and continues to be pulled by the link 188 causing the VTS support 160 to rotate counter-clockwise about the VTS axis 162, and the reverse gate 110 remains in the stowed position relative to the steering nozzle 102. The direction of rotation of the output portion 202 can be changed at any time (i.e. it does not need to be rotated from the position shown in FIG. 14 to the position shown in FIG. 20 before it can be rotated counter-clockwise, and vice versa). It is contemplated that the rotation of the output portion 202 could be stopped at any time to maintain a desired arrangement of the components.

It is contemplated that the rotary actuator 196 could be operatively connected to the VTS support 160 and the reverse gate 110 via components other than the main support 180 and still operate as described above. For example, it is contemplated that a system of cams and/or gears could be used.

Figure 21:
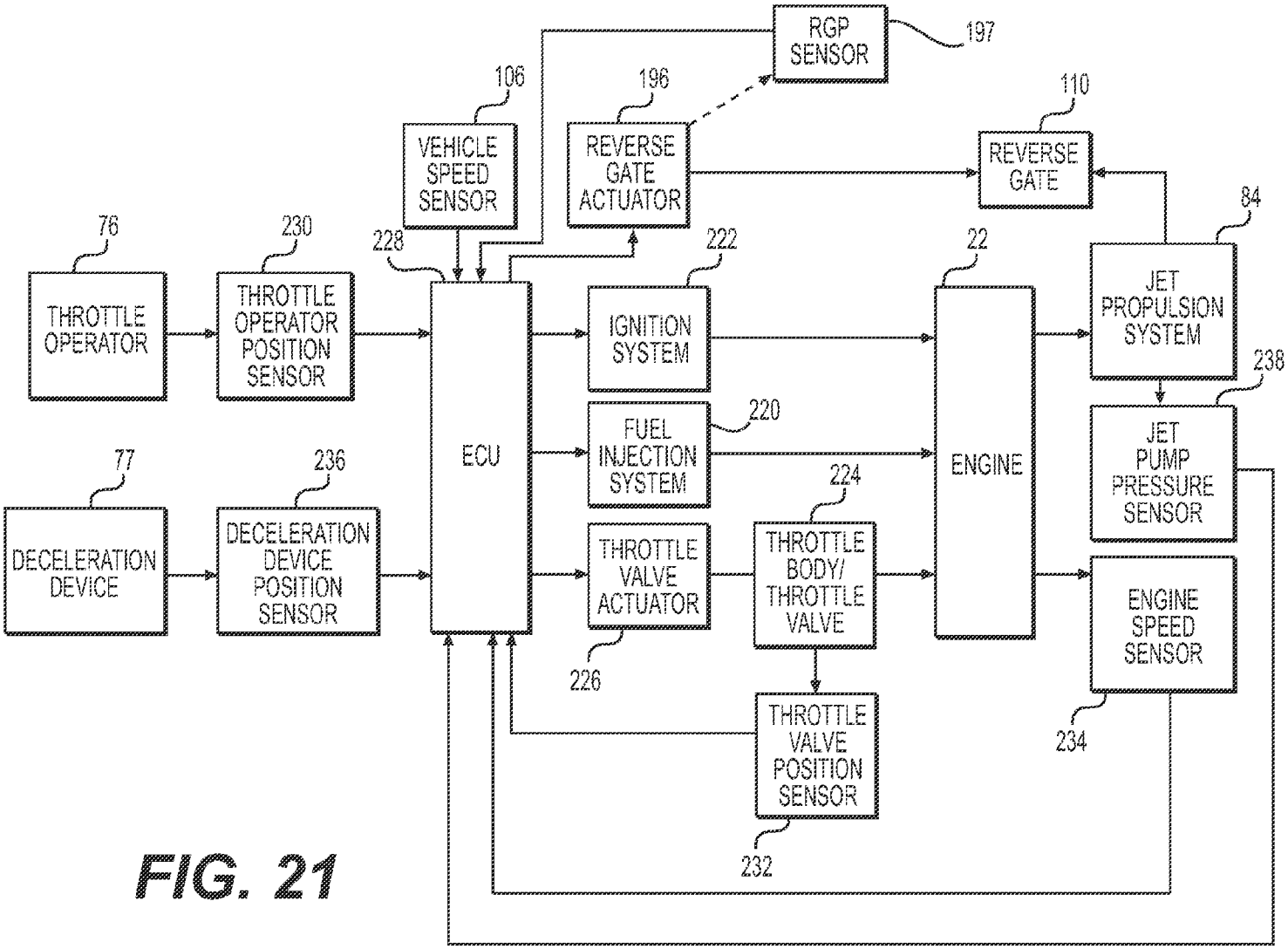
FIG. 21 is a schematic representation of some of the sensors and vehicle components present in a watercraft in accordance with the present technology.

Turning now to FIG. 21, the various sensors and vehicle components present in a watercraft in accordance with the present technology, such as those described above, will now be described. It is contemplated that not every sensor or component illustrated in FIG. 21 is required to achieve aspects of the present technology. It is also contemplated that, depending on the particular aspect of the technology, some of the sensors and components could be omitted, some of the sensors and components could be substituted by other types of sensor and components, and two or more sensors could be combined in a single sensor that can be used to perform multiple functions without departing from the scope of the present technology. Also, it is contemplated that the ECU 228 could be a single or a combination of multiple electronic controllers. For simplicity, the sensors and components will be described with reference to the personal watercraft 10. The jet propelled boat 120 is provided with the same or similar sensors and components.

As can be seen in FIG. 21, the engine 22 has a fuel injection system 220 and an ignition system 222 to control the amount of fuel provided to the engine 22 and combustion of a fuel/air mixture respectively. A throttle body having a throttle valve 224 controls the amount of air provided to the engine 22. A throttle valve actuator 226, in the form of an electric motor, is connected to the throttle valve 224 to move the throttle valve 224 to a desired position. The ECU 228, which is disposed in the watercraft 10 and used to control the operation of various elements of the watercraft 10, is in electronic communication with various sensors from which it receives signals. The ECU 228 uses these signals to control the operation of the ignition system 222, the fuel injection system 220, and the throttle valve actuator 226 in order to control the engine 22.

A throttle operator position sensor 230 senses a position of the throttle operator 76 and sends a signal representative of the throttle operator position to the ECU 228. As previously mentioned, the throttle operator 76 can be of any type, but in exemplary implementations of the technology it is selected from a group consisting of a thumb-actuated throttle lever, a finger-actuated throttle lever, and a twist grip. The throttle operator 76 is normally biased, typically by a spring, towards a position that is indicative of a desire for an idle operation of the engine 22 known as the idle position. In the case of a thumb or finger-actuated throttle lever, this is the position where the lever is furthest away from the handle to which it is mounted. Depending on the type of throttle operator 76, the throttle operator position sensor 230 is generally disposed in proximity to the throttle operator 76 and senses the movement of the throttle operator 76 or the linear displacement of a cable connected to the throttle operator 76. The throttle operator position sensor 230 is in the form of a magnetic position sensor. In this type of sensor, a magnet is mounted to the throttle operator 76 and a sensor chip is fixedly mounted in proximity to the magnet. As the magnet moves, due to movement of the throttle operator 76, the magnetic field sensed by the sensor chip varies. The sensor chip transmits a voltage corresponding to the sensed magnetic field, which corresponds to the position of the throttle operator 76, to the ECU 228. It is contemplated that the sensor chip could be the one mounted to the throttle operator 76 and that the magnet could be fixedly mounted in proximity to the sensor chip. The throttle operator position sensor 230 could also be in the form of a rheostat. A rheostat is a resistor which regulates current by means of variable resistance. In the present case, the position of the throttle operator 76 would determine the resistance in the rheostat which would result in a specific current being transmitted to the ECU 228. Therefore, this current is representative of the position of the throttle operator 76. It is contemplated that other types of sensors could be used as the throttle operator position sensor 230, such as a potentiometer which regulates voltage instead of current.

The vehicle speed sensor 106 senses the speed of the vehicle and sends a signal representative of the speed of the vehicle to the ECU 228. The ECU 228 sends a signal to a speed gauge located in the display cluster 78 of the watercraft 10 such that the speed gauge displays the watercraft speed to the driver of the watercraft 10.

A throttle valve position sensor 232 senses the position (i.e. the degree of opening) of the throttle valve 224 and sends a signal representative of the position of the throttle valve 224 to the ECU 228. The ECU 228 uses the signal received from the throttle valve position sensor 232 as a feedback to determine if the throttle valve actuator 226 has moved the throttle valve 224 to the desired position and can make adjustments accordingly. The ECU 228 can also use the signal from the throttle valve position sensor 232 actively to control the ignition system 222 and the fuel injection system 220 along with other signals depending on the specific control scheme used by the ECU 228. The throttle valve position sensor 232 can be any suitable type of sensor such as a rheostat and a potentiometer as described above with respect to the throttle operator position sensor 230. Depending on the type of throttle valve actuator 226 being used, a separate throttle valve position sensor 232 may not be necessary. For example, a separate throttle valve position sensor 232 would not be required if the throttle valve actuator 226 is a servo motor since servo motors integrate their own feedback circuit that corrects the position of the motor and thus have an integrated throttle position sensor 232.

An engine speed sensor 234 senses a speed of rotation of the engine 22 and sends a signal representative of the speed of rotation of the engine 22 to the ECU 228. Typically, an engine, such as the engine 22, has a toothed wheel disposed on and rotating with a shaft of the engine, such as the crankshaft or output shaft. The engine speed sensor 234 is located in proximity to the toothed wheel and sends a signal to the ECU 228 each time a tooth passes in front it. The ECU 228 can then determine the motor speed by calculating the time elapsed between each signal.

A deceleration device position sensor 236 senses a position of the deceleration device 77 (i.e. the deceleration lever 77) and sends a deceleration signal indicative of the deceleration device position to the ECU 228. The deceleration device position sensor 236 can be any suitable type of sensor such as a magnetic position sensor, a rheostat and a potentiometer as described above with respect to the throttle operator position sensor 230. The deceleration signal received from the deceleration device position sensor 236 by the ECU 228 is used by the ECU 228 to control the reverse gate actuator 196 and therefore the position of the reverse gate 110 as will be described below. It is contemplated that the deceleration position sensor 236 could send its deceleration signal to a dedicated electronic control unit that is physically separate from a main ECU and that this dedicated electronic control unit would control the reverse gate actuator 196. In such an implementation, the dedicated ECU and the main ECU together form at least part of the ECU 228.

A jet pump pressure sensor 238 senses a water pressure present in the jet pump 99 of the jet propulsion system 84. The jet pump pressure sensor 238 can be in the form of a pitot tube, but other types of pressure sensors are contemplated. The jet pump pressure sensor 238 sends a signal representative of the jet pump pressure to the ECU 228. The pressure in the jet pump 99 is representative of the amount of thrust being generated by the jet propulsion system 84. The jet pump pressure sensor 238 is used as a feedback to the ECU 228 to determine if a thrust request sent to the engine 22 by the ECU has resulted in a corresponding drop or increase in jet pump pressure. The jet pump pressure sensor 238 can also be used to determine if the jet pump 99 operates properly. For example, a jet pump pressure that is lower than expected could indicate that the inlet of the jet pump 99 is clogged. It is contemplated that the jet pump pressure sensor 238 could be omitted.

In the present implementation, the reverse gate actuator 196 has its own feedback circuit that corrects the position of the motor and thus has an integrated reverse gate position sensor 197 that can send signals to the ECU 228 representative of the position of the reverse gate 110. However, it is contemplated that a separate reverse gate position sensor could be provided. Such a reverse gate position sensor could sense the position of the reverse gate 110 or of the output portion 202 described above.

Turning now to FIGS. 22 to 24D, a method for decelerating the watercraft 10 will be described. A method for decelerating the jet propelled boat 120 is similar to the method described below, except that instead of initiating the method in response to the actuation of the lever 77, the method would be initiated in response to the actuation of the foot pedal 147, or another corresponding deceleration device. In the case of a jet propelled boat 120 having two jet propulsion systems 84 and therefore two reverse gates 110, the method would be simultaneously applied to both jet propulsion systems 84, both reverse gates 110 and, should the jet propelled boat 120 have two engines 22, both engines 22.

FIGS. 23A to 23D illustrate an example of the reverse gate position (RGP), the power level applied to the reverse gate actuator 196 (% PWM), the motor speed (RPM) and motor speed request (RPM request) resulting from the implementation of a gate operation mode A of the method for decelerating a watercraft 10 described below. FIGS. 24A to 24D illustrate an example of the reverse gate position (RGP), the power level applied to the reverse gate actuator 196 (% PWM), the motor speed (RPM) and motor speed request (RPM request) resulting from the implementation of a gate operation mode B, the delay, and the reverse gate operation mode C of the method for decelerating a watercraft 10 described below. In the present example, the control of the engine 22 is explained in terms of a response to a motor speed request. However, as previously explained, thrust is a function of motor speed and motor speed is a function of motor torque, therefore the engine 22 would similarly be controlled should the motor speed request be replaced by a thrust request or a torque request. Replacing the motor speed request on the vertical axis of FIGS. 23D and 24D by a thrust request or by a motor torque request would yield graphs having substantially the same characteristics. Depending on the particular starting conditions, type of watercraft, motor, jet propulsion system, reverse gate and reverse gate actuator, the curves could look different than illustrated. Also, the position of the times t0, t1, t2, t3, t4, t5, t6, t7, t8, t9 and t10 are intended to indicate the sequence of events in the method for decelerating the watercraft 10. It is contemplated that the relative time between events could differ from what is illustrated. For example, it is contemplated that the time between the events at t3 and t4 could be greater than the time between the events t4 and t5. Also, in some particular cases which will be described in greater detail below, it is contemplated that the order of two events could be inverted. Also, in the present example, the engine 22 has been given a maximum motor speed of 8000 rpm, a reverse gate actuation speed (RGA speed) of 6000 rpm, a watercraft deceleration speed of 4000 rpm and an idle motor speed of 2000 rpm. It is contemplated that these motor speeds could be different depending on the characteristics of the watercraft 10, the type of motor 22, jet propulsion system 84 and reverse gate 110, and other factors. Finally, the implementation of the method will be described with respect to an example where the watercraft 10 is initially operating with the engine 22 operating at the maximum motor speed and then being reduced to the idle motor speed. The method could be applied to a watercraft having an engine 22 initially operating at any motor speed (with any changes to the method explained below where necessary) and it is contemplated that the motor speed does not need to be reduced to the idle motor speed.

Figure 22:
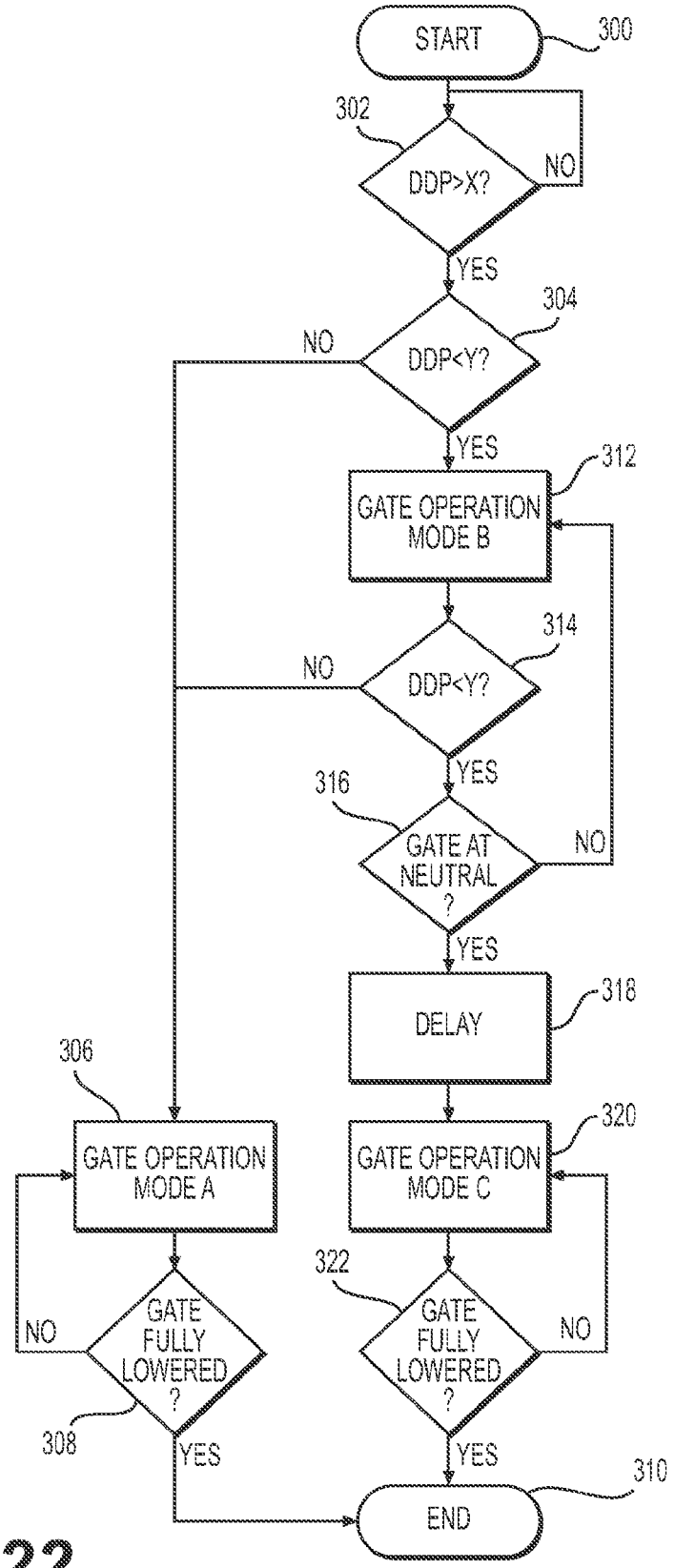
FIG. 22 is a flowchart of a method for decelerating a watercraft in accordance with the present technology.

As can be seen in FIG. 22, the method for decelerating the watercraft 10 starts at step 300 when the engine 22 of the watercraft 10 starts. At step 302, the ECU 228 receives a signal from the deceleration device position sensor 236 indicative of the position of the deceleration device 77 (deceleration device position (DDP)) and determines if this position is greater than a predetermined position X of the deceleration device 77. If the deceleration device position is not greater than the predetermined position X, then the ECU 228 determines that the deceleration device 77 is not in an actuated position indicative that deceleration is desired (i.e. deceleration is not desired), and the ECU 228 repeats step 302 (i.e. the position of the deceleration device 77 is continuously monitored). If at step 302 the deceleration device position is greater than the predetermined position X, the ECU 228 determines that the deceleration device 77 is in an actuated position indicative that deceleration is desired, the signal received from the deceleration device position sensor 236 is considered a deceleration signal, and the ECU 228 proceeds to step 304.

The deceleration device 77 is movable between a fully released position to a fully depressed position. For purposes of the present implementation, the deceleration device position is expressed in terms of percentages of actuation, with the fully released position corresponding to 0% and the fully depressed position corresponding to 100%. It is contemplated that the amount of actuation could be otherwise expressed, such as in degrees for example. In one implementation, the predetermined position X in step 302 described above corresponds to 0% of actuation. In another implementation, the predetermined position X in step 302 corresponds to a small percentage such as 2% for example. It is contemplated that the predetermined position X could be greater or smaller. In such an implementation, small percentages of actuation of the deceleration device 77, which could be unintentional, will not be considered by the ECU 228 at step 302 as being indicative that deceleration of the watercraft 10 is desired. Such small percentages of actuation may result, for example, from the driver readjusting his/her grip over the deceleration device 77 or from the driver's fingers pushing slightly on the deceleration as the watercraft 10 operates over choppy water while the driver has his/her fingers on the deceleration device 77, and as such are not being considered as being indicative of a desire to decelerate the watercraft.

At step 304, the ECU 228 determines if the deceleration signal received from the deceleration position sensor 236 at step 302 is indicative of an actuated position of the deceleration device 77 that is less than a predetermined position Y of the deceleration device 77. The predetermined position Y corresponds to a relatively large percentage of actuation of the deceleration device 77. In one exemplary implementation, the predetermined position Y corresponds to 87% of actuation of the deceleration device. It is contemplated that the predetermined position Y could be greater or smaller. It is also contemplated that the predetermined position Y could be the fully depressed position of the deceleration device 77 (i.e. 100%). If at step 304, the deceleration device position is not smaller than the predetermined position Y, the ECU 228 proceeds to step 306. If at step 304, the deceleration device position is smaller than the predetermined position Y, the ECU proceeds to step 312.

A higher percentage of actuation of the deceleration device is generally indicative of a desire by the driver of the watercraft 10 of a greater rate of deceleration of the watercraft 10. As such, when the deceleration device position is greater than or equal to the predetermined position Y, the ECU 228 controls the various components of the watercraft 10, including the reverse gate actuator 196 and the engine 22, such that the reverse gate 110 reaches a deceleration position in less time than when the deceleration device position is less than the predetermined position Y as will be described below. This means that, in an example where the deceleration position of the reverse gate 110 is the fully lowered position of the reverse gate 110 (shown in FIG. 20), the present method for decelerating the watercraft 10 results in the time elapsed from the reception of the deceleration signal by the ECU 228 at step 302 to the reverse gate 110 being fully lowered (step 310 below) being smaller if the actuated position of the deceleration device 77 is greater than or equal to the predetermined position Y than if it is less than the predetermined position Y. As will be also described below, when the deceleration device position is less than the predetermined position Y, the present method for decelerating the watercraft 10 results in the time elapsed from the reception of the deceleration signal by the ECU 228 at step 302 to the reverse gate 110 being fully lowered (step 310 below) being smaller as the actuated position of the deceleration device 77 is higher. Accordingly, the shorter the time taken to move the reverse gate 110 from the stowed position when the deceleration signal is received at step 302 to the reverse gate 110 being fully lowered, the greater the average speed of rotation of the reverse gate 110 over this range is.

Although not indicated at every possible location in the illustration of the method in FIG. 22, the ECU 228 continuously receives a signal from the deceleration device position sensor 236 and adjusts the control of the reverse gate 110 and the engine 22 should the position of the deceleration device 77 vary while the method is being carried out. For example, should the deceleration device position be initially greater than or equal to the predetermined position Y at step 304, but then changes to be less than the predetermined position Y, the ECU 228 will adjust the control method to switch over to the one of steps 312 to 322 that corresponds to the current position of the reverse gate 110. Similarly, should the deceleration device position become less than or equal to the predetermined position X at any time following step 304 as a result of the driver releasing the deceleration device 77, the ECU 228 exits the deceleration control method, raises the reverse gate 100 back to the fully stowed position (or another stowed position), resumes normal engine operation, and returns to step 302 to monitor the position of the deceleration device 77.

Returning to step 304 of the method illustrated in FIG. 22, as discussed above, when the deceleration device position is greater than or equal to the predetermined position Y, the ECU 228 proceeds to step 306. At step 306, the ECU 228 controls the reverse gate actuator 196 and the engine 22 according to the reverse gate operation mode A. In the reverse gate operation mode A, the ECU 228 applies a high power level to the reverse gate actuator 196 in order to move the reverse gate 110 quickly from a stowed position to a deceleration position in an uninterrupted rotation. In some implementations, the power level applied to the reverse gate actuator 196 is a maximum power level (i.e. 100% PWM). Once the reverse gate operation mode A is initiated, the control of the reverse gate actuator 106 is independent of the actual position of the deceleration device 77, as long as it is greater than or equal to the predetermined position Y. In other words, the control of the reverse gate actuator 196 is the same for any position of the deceleration device 77 that is greater than or equal to the predetermined position Y. During the reverse gate operation mode A, the ECU 228 also controls the engine 22 independently of the actual position of the throttle operator 76 as sensed by the throttle operator position sensor 230. The reverse gate operation mode A will be described in more detail below with respect to the example illustrated in FIGS. 23A to 23D.

As step 306 is being performed, the ECU 228 performs step 308, which for purposes of illustration is shown following step 306 in FIG. 22. At step 308, the ECU 228 receives a signal from the reverse gate position sensor 197 indicative of the position of the reverse gate 110 to determine if the reverse gate 110 has reached the fully lowered position. If at step 308 the reverse gate 110 is not fully lowered, the ECU 228 continues to control the reverse gate actuator 196 and engine 22 according to the reverse gate operation mode A at step 306. If at step 308 the reverse gate 110 is fully lowered, the ECU 228 proceeds to step 310 and stops supplying power to the reverse gate actuator 196 to stop the rotation of the reverse gate 110. The ECU 228 continues to control the engine 22 to generate a deceleration thrust as long as the driver does not release the deceleration device 77. As a result, the watercraft 10 decelerates, comes to rest and, should the driver continue to actuate the deceleration device 77, then starts to move in reverse. It is contemplated that the position of the reverse gate 110 used at step 308 could be a deceleration position of the reverse gate 110 other than the fully lowered position.

Returning to step 304 of the method illustrated in FIG. 22, as discussed above, when the deceleration device position is less than the predetermined position Y, the ECU 228 proceeds to step 312. At step 312, the ECU 228 controls the reverse gate actuator 196 and the engine 22 according to the reverse gate operation mode B. In the reverse gate operation mode B, the ECU 228 applies a power level to the reverse gate actuator 196 in order to move the reverse gate 110 from a stowed position to a neutral position. In the present implementation, the power level applied to the reverse gate actuator 196 in reverse gate operation mode B is the same as in the reverse gate operation mode A. Once the reverse gate operation mode B is initiated and until the reverse gate 110 reaches the neutral position, the control of the reverse gate actuator 106 is independent of the actual position of the deceleration device 77, as long as it is greater than or equal to the predetermined position X and less than the predetermined position Y. In other words, until the reverse gate 110 gets to the neutral position, the control of the reverse gate actuator 196 is the same for any position of the deceleration device 77 that is between the predetermined positions X and Y. During the reverse gate operation mode B, for gate positions between the stowed position and the neutral position, the ECU 228 also controls the engine 22 independently of the actual position of the throttle operator 76 as sensed by the throttle operator position sensor 230. The reverse gate operation mode B will be described in more detail below with respect to the example illustrated in FIGS. 24A to 24D.

As step 312 is being performed, the ECU 228 performs steps 314, 316, which for purposes of illustration are shown sequentially following step 312 in FIG. 22. At step 314, the ECU 228 determines from a signal received from the deceleration device position sensor 236 if the deceleration device position is still less than the predetermined position Y. If it is not, the ECU 228 proceeds to control the reverse gate actuator 196 and engine 22 according to the reverse gate operation mode A at step 306 described above. If at step 314 it is determined that the deceleration device position is still less than the predetermined position Y, the ECU 228 then proceeds to step 316. At step 316, the ECU 228 receives a signal from the reverse gate position sensor 197 indicative of the position of the reverse gate 110 to determine if the reverse gate 110 has reached the neutral position. If at step 316 the reverse gate 110 is not at the neutral position, the ECU 228 continues to control the reverse gate actuator 196 and engine 22 according to the reverse gate operation mode B at step 312. If at step 316 the reverse gate 110 is at the neutral position, the ECU 228 proceeds to step 318 described below. It is contemplated that the position of the reverse gate 110 used at step 316 could be another position of the reverse gate 110 that is intermediate the fully stowed position and the fully lowered position.

At step 318, the ECU 228 stops supplying power to the reverse gate actuator 196 to stop the rotation of the reverse gate 110 and keep it in the neutral position. The reverse gate 110 is kept in the neutral position for a predetermined time delay. In one implementation, the delay is a constant amount of time independent of the position of the deceleration device 77. In some implementations, the delay is less than one second. In other implementations, the delay is less than half a second. It is contemplated that the delay could depend at least in part on the actuated position of the deceleration device 77 such that the delay would be longer as the actuated position of the deceleration gets smaller. Once the delay has expired, the ECU 228 proceeds to step 320. It is contemplated that the delay of step 318 could be omitted and that the ECU 228 could proceed directly from step 316 to step 320 such that there would be no interruption of the rotation of the reverse gate 110.

At step 320, the ECU 228 controls the reverse gate actuator 196 and the engine 22 according to a reverse gate operation mode C. In the reverse gate operation mode C, the ECU 228 applies a power level to the reverse gate actuator 196 that is dependent on the actuated position of the deceleration device 77 in order to move the reverse gate 110 from the neutral position to the fully lowered position at a speed of rotation that is dependent on the actuated position of the deceleration device 77. The power level applied to the reverse gate actuator 196, and therefore the speed of rotation of the reverse gate 110, is higher as the actuated position of the deceleration device is greater. In some implementations, the ECU 228 uses the actuated position of the deceleration device 77 to determine the power level to be applied to the reverse gate actuator 196 from a lookup table. It is contemplated that the power level could go up in steps, such that the power level has a first value for a first range of actuated positions of the deceleration device 77, a second higher value for a second greater range of actuated positions and so on. It is also contemplated that the ECU 228 could determine the power level to be applied from a map, a graph or a mathematical formula. It is also contemplated that the power level could be determined by taking into consideration other variables in addition to the actuated position of the deceleration device 77, such as the speed of the engine for example. In the present implementation, the power level applied to the reverse gate actuator 196 is smaller in the reverse gate operation mode C than in the reverse gate operation modes A and B. As such, in the present implementation, the speed of rotation the reverse gate actuator 196 is smaller in the reverse gate operation mode C than in the reverse gate operation modes A and B. During the reverse gate operation mode C, the ECU 228 also controls the engine 22 independently of the actual position of the throttle operator 76 as sensed by the throttle operator position sensor 230. The reverse gate operation mode C will be described in more detail below with respect to the example illustrated in FIGS. 24A to 24D.

As step 320 is being performed, the ECU 228 performs step 322, which for purposes of illustration is shown following step 320 in FIG. 22. At step 322, the ECU 228 receives a signal from the reverse gate position sensor 197 indicative of the position of the reverse gate 110 to determine if the reverse gate 110 has reached the fully lowered position. If at step 322 the reverse gate 110 is not fully lowered, the ECU 228 continues to control the reverse gate actuator 196 and engine 22 according to the reverse gate operation mode C at step 320. If at step 322 the reverse gate 110 is fully lowered, the ECU 228 proceeds to step 310 and stops supplying power to the reverse gate actuator 196 to stop the rotation of the reverse gate 110. The ECU 228 continues to control the engine 22 to generate a deceleration thrust as long as the driver does not release the deceleration device 77. As a result, the watercraft 10 decelerates, comes to rest and, should the driver continue to actuate the deceleration device 77, then starts to move in reverse. It is contemplated that the position of the reverse gate 110 used at step 322 could be a deceleration position of the reverse gate 110 other than the fully lowered position.

It is contemplated that in an alternative implementation, steps 304, 306, 308 and 314 could be omitted. In such an implementation, the delay 318 could be omitted completely or could be applied only when the deceleration device position is less than the predetermined position Y. It is also contemplated that in another alternative implementation, steps 312, 314, 316 and 318 could be omitted, such that the ECU 228 controls the operation of the reverse gate actuator 196 and the engine 22 for the full range of rotation of the reverse gate 110 according to the reverse gate operation mode A when the deceleration device position is greater or equal to the predetermined position Y and according to the reverse gate operation mode C when the deceleration device position is less than the predetermined position Y. It is also contemplated that in yet another alternative implementation, steps 304, 306, 308, 312, 314, 316 and 318 could be omitted, such that the ECU 228 controls the operation of the reverse gate actuator 196 and the engine 22 for the full range of rotation of the reverse gate 110 according to the reverse gate operation mode C for any actuated position of the deceleration device 77 greater than the predetermined position X.

Turning now to FIGS. 23A to 23D, an example of the method for decelerating the watercraft 10 when the deceleration device 77 is moved by the driver of the watercraft 10 to an actuated position that is greater than or equal to the predetermined position Y will be described. Where applicable, reference to the steps of FIG. 22 will be made during the description of this example.

At time t0, the ECU 228 is operating the engine 22 at its maximum thrust and its maximum speed. From time t0 to time t1, the ECU 228 continues to receive signals from the throttle operator position sensor 230 that the throttle operator 76 is at a position corresponding to a desire of the driver to continue operating the engine 22 at its maximum thrust and maximum speed. As a result, and as can be seen in FIG. 23D, the motor speed request determined by the ECU 228 corresponds to the maximum motor speed of 8000 rpm. The ECU 228 sends signals to the ignition system 222, the fuel injection system 220 and the throttle valve actuator 226 to control these elements such that the engine 22 operates at 8000 rpm, which it does as seen in FIG. 23C. It is contemplated that the ECU 228 could limit the maximum motor speed to a motor speed which is less than the maximum motor speed of which the engine 22 is capable even if the position of the throttle operator 76 is indicative of a desire of the driver to have a higher motor speed. At time t0, the deceleration device 77 is not actuated (i.e. DDP=0%), and as such, based on the signal received from the deceleration device position sensor 230 by the ECU 228, the ECU 228 controls the reverse gate actuator 196 to maintain the reverse gate 110 in the position P1 (FIG. 23A) corresponding to the fully stowed position (FIG. 14). The ECU 228 not sending any signal to the reverse gate actuator 196 such that the reverse gate actuator 196 is not powered (see FIG. 23B, power level=0% PWM) is considered, for the present purpose, controlling the reverse gate actuator 196. It is contemplated that when the deceleration device 77 is not actuated, the reverse gate 110 could be maintained in a stowed position other than the fully stowed position, such as the position shown in FIG. 15 or 16 for example.

In the present example, the throttle operator 76 continues to be in the position corresponding to a desire of the driver to operate the engine 22 at its maximum speed and the deceleration device 77 is not actuated until time t1. As such, as can be seen in FIGS. 23A to 23D, the conditions described above remain the same between time t0 and time t1.

At time t1, the driver actuates the deceleration device 77 (i.e. by pressing the lever 77) to an actuated position greater than or equal to the predetermined position Y, and the deceleration device position sensor 236 sends a deceleration signal to the ECU 228. Once the deceleration signal has been received by the ECU 228, and as long as the driver actuates the deceleration device 77, the following steps of the method (i.e. the events occurring at times t1, t2, t3, t4, t5 and t6) occur without any further driver intervention. This means that once the driver has actuated the deceleration device at time t1, the other events occurring at time t1 and the events occurring at times t2, t3, t4, t5 and t6 described below will occur as a result of actions controlled by the ECU 228 and not the driver. It is contemplated that in some alternative implementations, the driver may perform some actions that affect one aspect or another of the method.

In response to the deceleration device 77 being actuated at time t1, the ECU 228 proceeds from step 302, to step 304 and then to step 306 to control the various components of the watercraft 10 according to the reverse gate operation mode A. At time t1, the speed request determined by the ECU 228 is reduced to the idle motor speed of 2000 rpm as can be seen in FIG. 23D. This is done regardless of the actual position of the throttle operator 76. The ECU 228 sends signals to the ignition system 222, the fuel injection system 220 and the throttle valve actuator 226 to control these elements such that the motor speed of the engine 22 is reduced to 2000 rpm. As can be seen in FIG. 23C, the motor speed starts reducing at time t1 in response to the reduction of the motor speed request, but as can be seen this reduction is gradual and the engine 22 will only reach the idle motor speed at time t3. It is contemplated that at time t1, the motor speed request could be reduced to a motor speed request corresponding to a motor speed that is greater than the idle motor speed.

It is also contemplated that the reduction of the motor speed at time t1 could also be achieved by the ECU 228 reducing the maximum motor speed request limit. In such an implementation, should the throttle operator 76 be in a position that corresponds to a motor speed request at or above the now reduced maximum motor speed request limit, the motor speed request will be the reduced to the maximum motor speed request limit. However, should the throttle operator 76 be in a position that corresponds to a motor speed request below the now reduced maximum motor speed request limit, the motor speed request will be determined by the ECU 228 based on the actual position of the throttle operator 76 as sensed by the throttle operator position sensor 230.

Figure 23A:
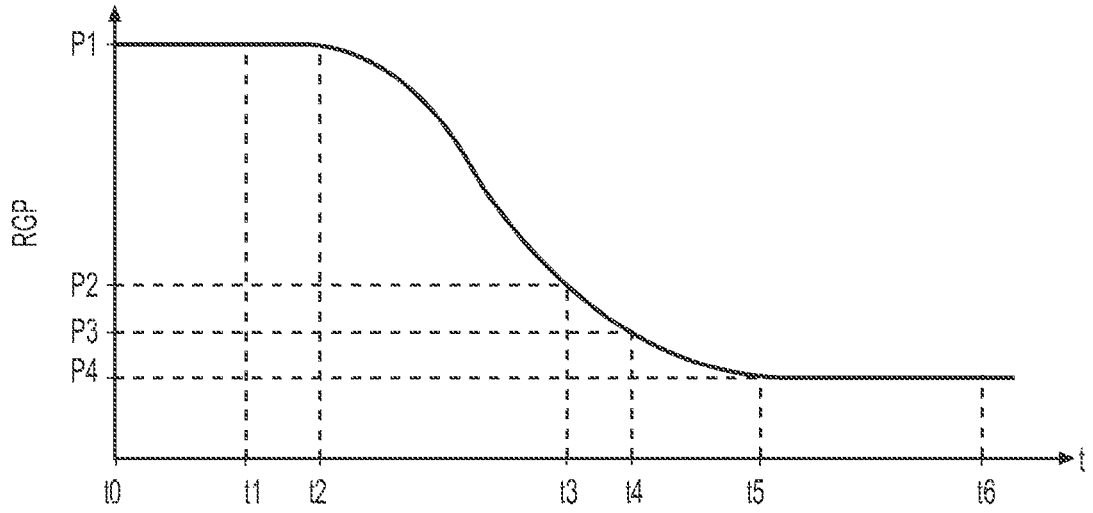
FIG. 23A is an exemplary graph of reverse gate position (RGP) versus time resulting from an implementation of a gate operation mode A of the method for decelerating a watercraft of FIG. 22.
Figure 23B:
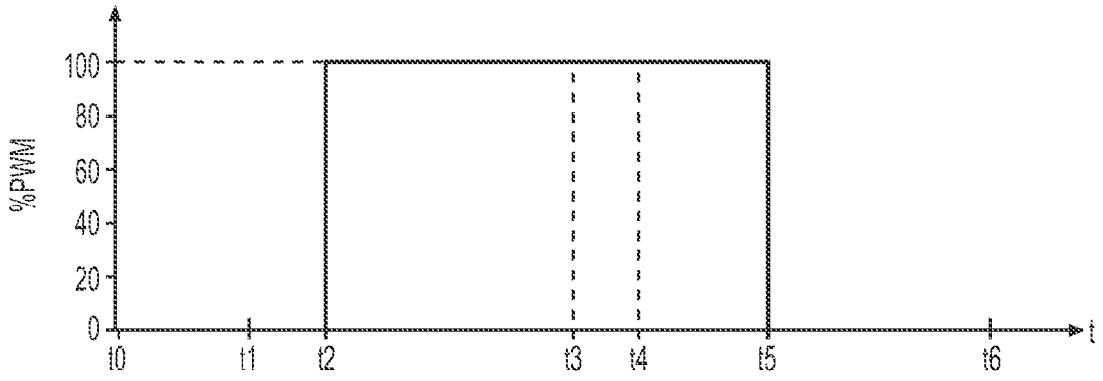
FIG. 23B is an exemplary graph of a power level applied to a reverse gate actuator (% PWM) versus time resulting from the implementation of the gate operation mode A of the method for decelerating a watercraft of FIG. 22.
Figure 23C:
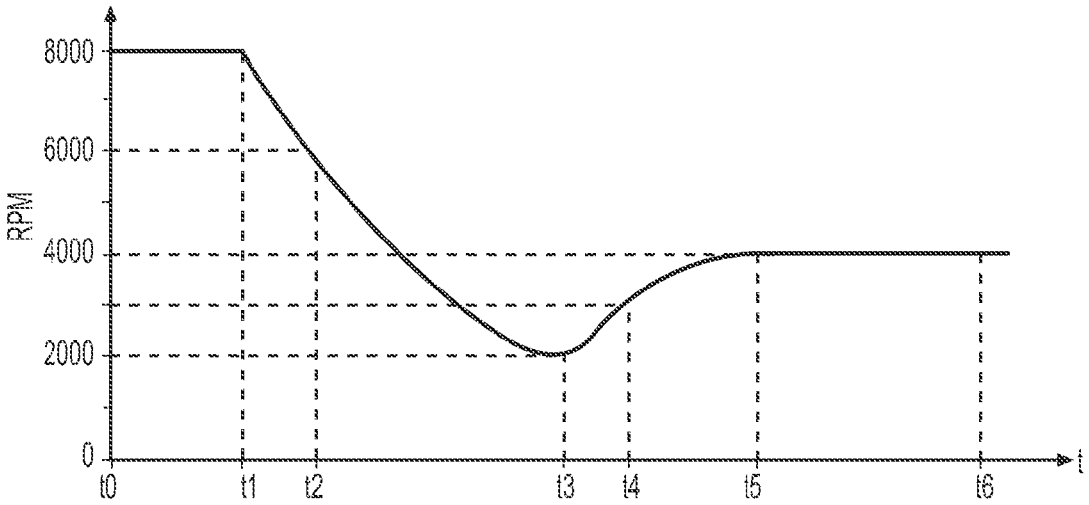
FIG. 23C is an exemplary graph of motor speed (RPM) versus time resulting from the implementation of the gate operation mode A of the method for decelerating a watercraft of FIG. 22.
Figure 23D:
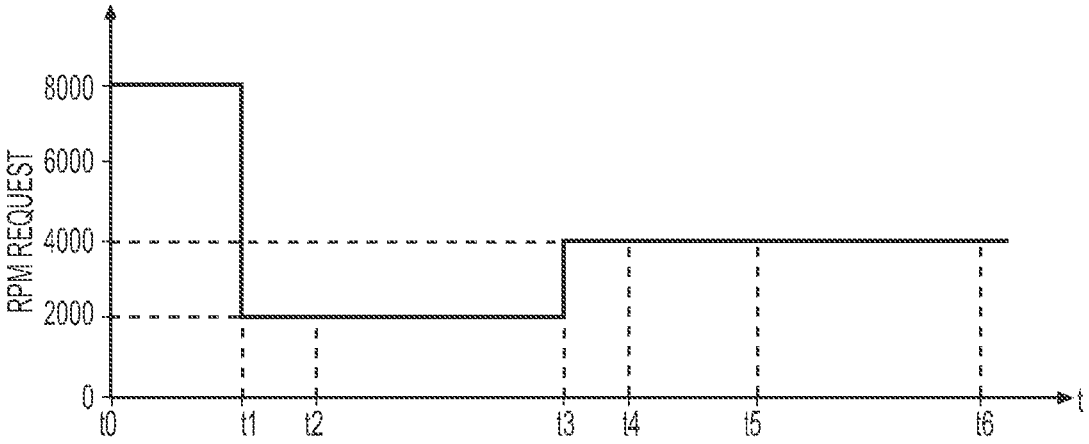
FIG. 23D is an exemplary graph of motor speed request (RPM request) versus time resulting from the implementation of the gate operation mode A of the method for decelerating a watercraft of FIG. 22.

As can be seen in FIG. 23A, although the motor speed starts reducing at time t1, the power level applied to the reverse gate actuator 196 remains 0% PWM and the reverse gate 110 remains at the fully stowed position P1 until time t2. This is because the thrust generated by the jet propulsion system 84 at the maximum motor speed is too high. Should the ECU 228 send a signal to the reverse gate actuator 196 to start lowering the reverse gate 110 to a lowered position right away, the reverse gate 110 could be pushed back up by the thrust generated by the jet propulsion system 84 and/or the reverse gate 110 could be damaged by the thrust generated by the jet propulsion system 84 and/or the reverse gate actuator 196 could be damaged by the resistance to movement of the reverse gate 110 due to the thrust generated by the jet propulsion system 84. As such, the ECU 228 does not cause power to be applied to the reverse gate actuator 196 to start moving the reverse gate toward the fully lowered position (FIG. 20) until time t2 where the motor speed has been reduced to the reverse gate actuation (RGA) speed (or lower). As explained above, in the present example the RGA speed is 6000 rpm. As can be seen in FIG. 23B, once the engine 22 operates at a motor speed corresponding to the RGA speed or less at time t2, the ECU 228 causes a power level of 100% PWM to be applied to the reverse gate actuator 196 to start lowering the reverse gate 110 toward the fully lowered position. It is contemplated that a power level that is less than 100% PWM could be applied to the reverse gate actuator 196 at time t2.

In an alternative implementation, the ECU 228 also determines if a predetermined amount of time has elapsed since the deceleration device 77 has been actuated at time t1. In this implementation, the ECU 228 sends the actuation signal to the reverse gate actuator 196 to start lowering the reverse gate 110 toward the fully lowered position once the motor speed is at or less than the RGA speed or once the predetermined amount of time has elapsed, whichever occurs first.

In an example where at time t1 the motor speed of the engine 22 is already at or below the RGA speed, the ECU 228 would cause power to be applied to the reverse gate actuator 196 to start lowering the reverse gate 110 toward the fully lowered position right away (i.e. at time t1). It is also contemplated that the reverse gate 110, its connection to the watercraft 10 and the reverse gate actuator 196 could be sturdy enough that the reverse gate 110 could be lowered even when the engine 22 is operating at its maximum motor speed and generating its maximum amount of thrust. In such an implementation, the reverse gate 110 could also start to be lowered right away at time t1 once the deceleration device 77 is actuated.

Should the driver completely release the deceleration device 77 at any point after time t1, in an exemplary implementation, the ECU 228 sends a signal to the reverse gate actuator 196 to return the reverse gate 110 to the fully stowed position P1 and controls the ignition system 222, the fuel injection system 220 and the throttle valve actuator 226 to gradually change the motor speed to correspond to the motor speed request determined by the ECU 228 that is based on the actual position of the throttle operator 76 determined by the throttle operator position sensor 230. In an alternative implementation, after the deceleration device 77 has been completely released, the throttle operator 76 first has to be completely released before the ECU 228 begins to control the motor speed based on the signal received from the throttle operator position sensor 230.

Returning to the example illustrated in FIGS. 23A to 23D, from time t2 a power level of 100% PWM continues to be applied to the reverse gate actuator 228, the reverse gate actuator 196 continues to lower the reverse gate 110 toward a deceleration position, which in the present implementation is the fully lowered position P4, and the motor speed continues to be reduced toward the motor speed request of 2000 rpm which has remained constant.

Figure 18:
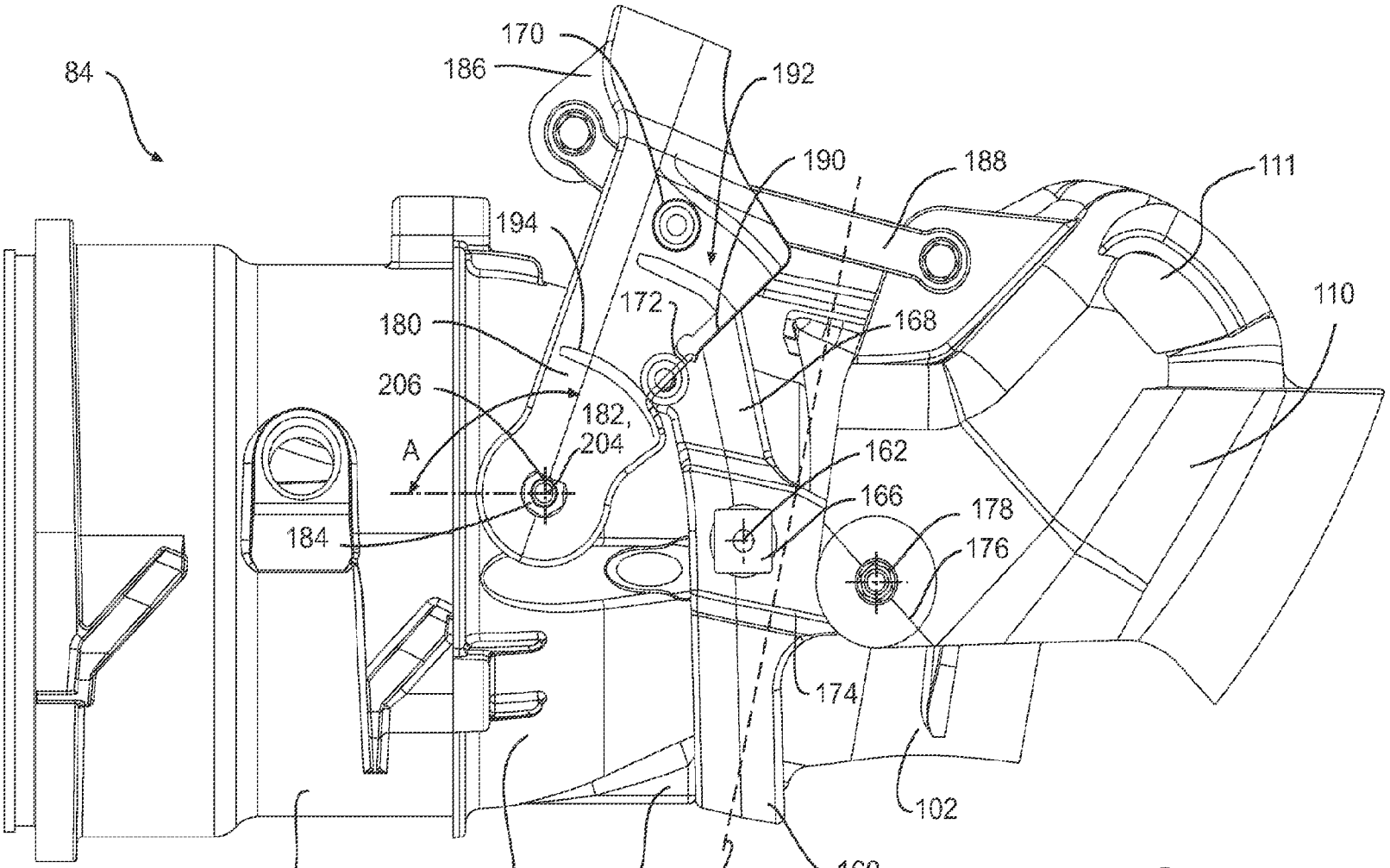
FIG. 18 is a left side view of the jet propulsion system of FIG. 10 with the VTS in a VTS down position and the reverse gate in a neutral position.
Figure 19:
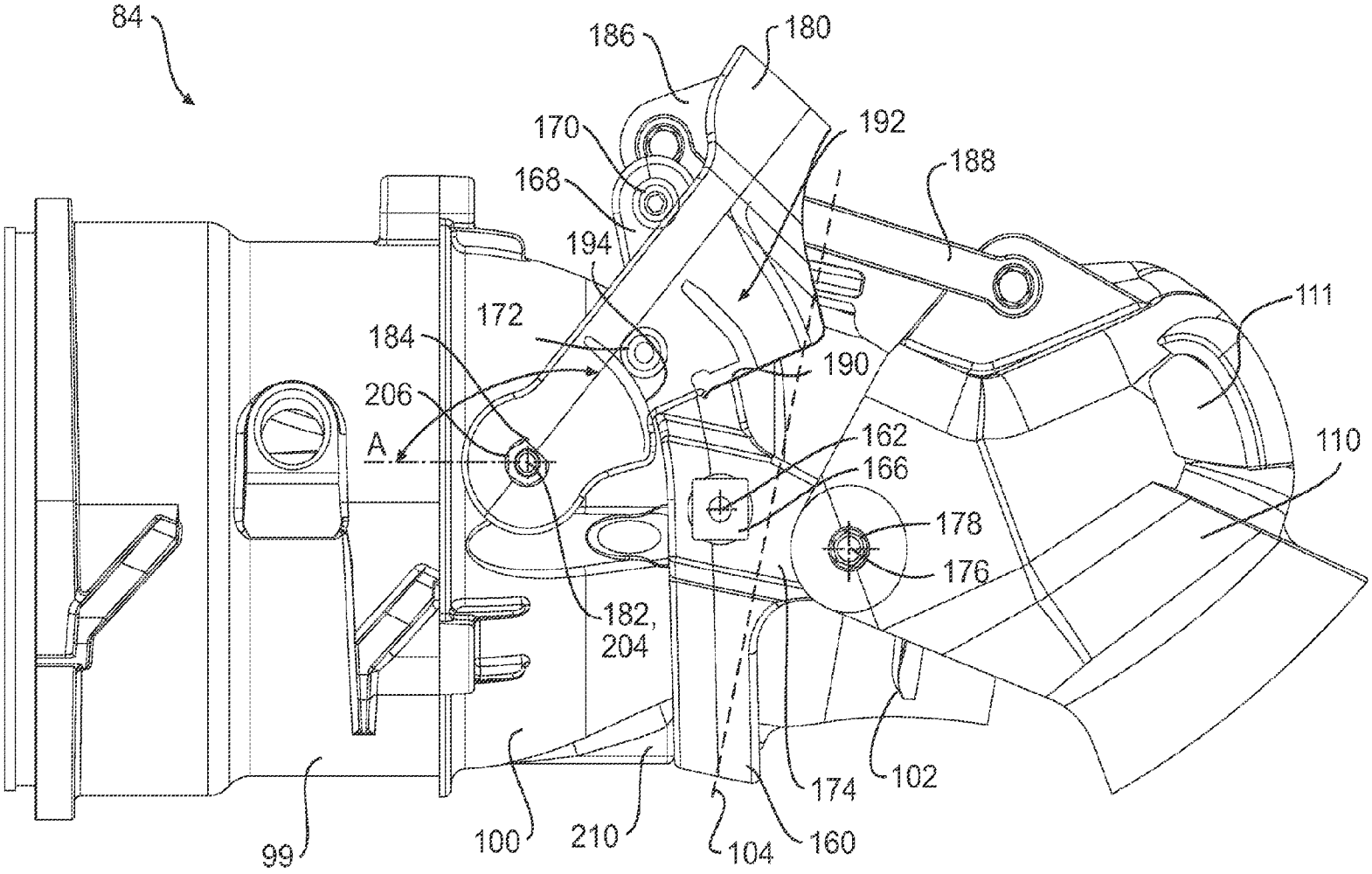
FIG. 19 is a left side view of the jet propulsion system of FIG. 10 with the VTS in a VTS down position and the reverse gate in a lowered position.

At time t3, as the reverse gate 110 continues to be lowered toward the fully lowered position P4, the reverse gate 110 reaches an intermediate position P2 between the fully stowed position P1 (FIG. 14) and the neutral position P3 (FIG. 18). The ECU 228 increases the motor speed request to a watercraft deceleration speed request in response to the reverse gate 110 reaching the intermediate position P2. As indicated above, in the present example, the watercraft deceleration speed is 4000 rpm. At time t3, the ECU 228 sends signals to the ignition system 222, the fuel injection system 220 and the throttle valve actuator 226 to control these elements such that the motor speed of the engine 22 is gradually increased to 4000 rpm. As can be seen in FIG. 23C, starting at time t3, the motor speed starts increasing in response to the increase of the motor speed request. In the present example, the motor speed request will remain at 4000 rpm for the remainder of the method until the deceleration device 77 is released.

In the present example, time t3 also corresponds to the time where the motor speed reaches the idle motor speed of 2000 rpm, however these two events do not need to be simultaneous. It is contemplated that the motor speed request could be increased before the motor speed reaches the idle motor speed, in which case the idle motor speed would not be reached by the engine 22. It is also contemplated that the motor speed request could be increased after the motor speed reaches the idle motor speed, in which case the engine 22 would operate at the idle motor speed for a certain period of time before the motor speed is increased. The motor speed request is increased at time t3 in response to the reverse gate 110 reaching the intermediate reverse gate position P2 at time t3, not in response to the motor speed reaching the idle motor speed. Depending on the operating conditions, and in particular the load on the engine 22, the rate at which the motor speed increases or decreases in response to a change in motor speed request (or thrust request) will vary.

As indicated above, in the present implementation the intermediate position P2 of the reverse gate 110 at which the motor speed request is increased is between the fully stowed position P1 and the fully lowered position P4. More specifically, in the present example, the intermediate position P2 is a position of the reverse gate 110 that is between 10 degrees above a middle position of the reverse gate 110 and 20 degrees below the middle position of the reverse gate 110. The middle position of the reverse gate 110 is the position of the reverse gate 110 that is halfway between the fully stowed position P1 and the fully lowered position P4.

It is also contemplated that the ECU 228 could increase the motor speed request at any reverse gate position between the fully stowed position P1 and the fully lowered position P4. However, in some reverse gates, due to their shapes, the lowered position where the thrust from the jet of water expelled by the jet propulsion system 84 applies the greatest moment on the reverse gate 110 to move the reverse gate 110 back toward the fully stowed position P1, referred to herein as the kick-back position, is a position that is lower than the position where the reverse gate 110 first makes contact with the jet of water expelled by the jet propulsion system 84. For such reverse gates, it is contemplated that the ECU 228 could increase the motor speed request at any reverse gate position between the kick-back position and the fully lowered position P4. It is also contemplated that the ECU 228 could increase the motor speed request at any reverse gate position between the neutral position P3 and the fully lowered position P4. In such an implementation, the events occurring at time t3 described above would occur between time t4 and time t5.

Returning to the example of FIGS. 23A to 23D, after time t3, the power level of 100% PWM continues to be applied to the reverse gate actuator 196, the reverse gate 110 continues to be lowered, reaches its neutral position P3 at time t4 and finally reaches its fully lowered position P4 at time t5. Also, after time t3, the motor speed continues to increase until it reaches the watercraft deceleration speed of 4000 rpm slightly before time t5. It is contemplated that the watercraft deceleration speed could be reached sooner before time t5 or after time t5.

At time t5, since the revere gate 110 has reached the fully lowered position 196, the ECU 228 stops controlling in the reverse gate operation mode A and proceeds from step 308 to step 310. As a result, at time t5, as can be seen in FIG. 23B the ECU 228 causes power to stop being applied to the reverse gate actuator 196. From time t5, the reverse gate 110 remains in the fully lowered position P4 and the motor speed remains at the watercraft deceleration speed of 4000 rpm. The thrust resulting form the water being redirected forward by the reverse gate 110 decelerates the watercraft 10 until it reaches a watercraft speed of 0 km/h at time t6. At time t6, should the deceleration device 77 continue to be actuated, since the reverse gate 110 remains in the fully lowered position P4 and the motor speed is still 4000 rpm, the watercraft 10 starts moving in the reverse direction.

It is contemplated that the power level applied to the reverse gate actuator 196 from time t2 to time t5 could not be constant and/or could be less than 100% PWM.

It is contemplated that once the watercraft 10 starts moving in the reverse direction, or once the watercraft slows to a low speed threshold, for example 14 km/h, the ECU 228 could control the motor speed request based on a degree of actuation of the deceleration device 77 and/or a degree of actuation of the throttle operator 76.

It is also contemplated that once the watercraft 10 reaches a watercraft speed of 0 km/h at time t6, or a low speed slightly sooner, that the ECU 228 could cause power to be applied to the reverse gate actuator 196 to move the reverse gate 110 to the neutral position P2 and reduces the motor speed request to the idle motor speed request to return the motor speed to the idle motor speed. Once the reverse gate 110 is in the neutral position P2 and the motor speed is the idle motor speed, the watercraft 10 will remain in position (unless some external factor, such as a water current or wind for example, acts on it). In such an implementation, should the deceleration device 77 be released, the reverse gate 110 remains in the neutral position P2 and the motor speed remains the idle motor speed until either the deceleration device 77 or the throttle operator 76 is actuated. Should the deceleration device 77 be actuated, the ECU 228 causes power to be applied to the reverse gate actuator 196 to lower the reverse gate 110 to a predetermined position or a position based on the degree of actuation of the deceleration device 77 and controls the motor speed to be at a predetermined motor speed or based on the degree of actuation of the deceleration device 77 or based on the degree of actuation of the throttle operator 76 where the throttle operator 76 is actuated at the same time as the deceleration device 77 (for implementations where the throttle actuator 76 can be used to affect the motor speed during reverse operation of the watercraft 10). Should the throttle operator 76 be actuated while the deceleration device 77 is not actuated, the ECU 228 sends an actuation signal to the reverse gate actuator 196 to return the reverse gate 110 to the fully stowed position P1 or some other stowed position and controls the motor speed based on the position of the throttle operator 76.

It is also contemplated that instead of selecting a watercraft deceleration speed request at time t3 that results in the motor speed being essentially constant following time t5, that the watercraft deceleration speed request could be selected such that the motor speed continues to gradually increase past time t5. It is contemplated that in such an implementation the motor speed could be reduced gradually once the speed of the watercraft 10 nears 0 km/h.

Turning now to FIGS. 24A to 24D, an example of the method for decelerating the watercraft 10 when the deceleration device 77 is moved by the driver of the watercraft 10 to an actuated position that is less than the predetermined position Y, but greater than the predetermined position X will be described. For purposes of this example, the deceleration device 77 remains in the same position until the end of the method (i.e. step 310 of FIG. 22). Where applicable, reference to the steps of FIG. 22 will be made during the description of this example.

At time t0, the ECU 228 is operating the engine 22 at its maximum thrust and its maximum speed. As can be seen by comparing FIGS. 23A to 23D to FIGS. 24A to 24D, from time t0 to time t1, the ECU 228 continues to control the engine 22 and the reverse gate actuator 196 as in the example of FIGS. 23A to 23D.

At time t1, the driver actuates the deceleration device 77 (i.e. by pressing the lever 77) to an actuated position less than the predetermined position Y and greater than the predetermined position X, and the deceleration device position sensor 236 sends a deceleration signal to the ECU 228. Once the deceleration signal has been received by the ECU 228, and as long as the driver continues to actuate the deceleration device 77, the following steps of the method (i.e. the events occurring at times t1, t2, t3, t4, t7, t8, t9 and t10) occur without any further driver intervention. This means that once the driver has actuated the deceleration device at time t1, the other events occurring at time t1 and the events occurring at times t2, t3, t4, t7, t8, t9 and t10 described below will occur as a result of actions controlled by the ECU 228 and not the driver. It is contemplated that in some alternative implementations, the driver may perform some actions that affect one aspect or another of the method.

In response to the deceleration device 77 being actuated at time t1, the ECU 228 proceeds from step 302, to step 304 and then to step 312 to control the various components of the watercraft 10 according to the reverse gate operation mode B. As can be seen by comparing FIGS. 23A to 23D to FIGS. 24A to 24D, from time t1 to time t3, in the present example, the ECU 228 control the engine 22 and the reverse gate actuator 196 as in the example of FIGS. 23A to 23D and the events from time t1 to time t3 in FIGS. 24A to 24D will not be described. As such, from time t1 to time t3, the reverse gate operation modes A and B are identical. It is contemplated that from time t1 to time t3 the reverse gate operation modes A and B could be different. For example, it is contemplated that in the reverse gate operation mode B, the power level applied to the reverse gate actuator 196 from time t1 to time 3 could be lower than illustrated and/or could be based on the actuated position of the deceleration device 77. The ECU 228 continues to control the various components of the watercraft 10 according to the reverse gate operation mode B from time t3 to time t4.

Figure 24A:
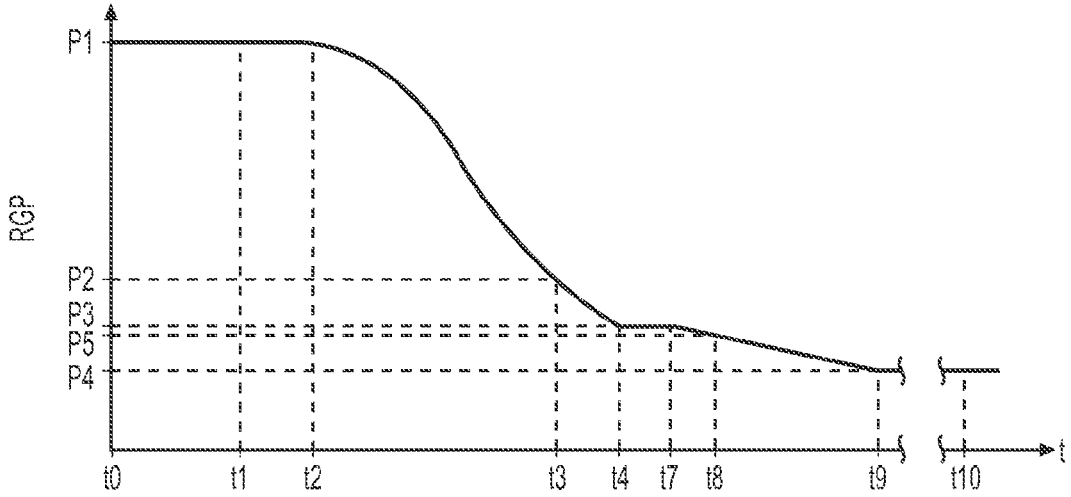
FIG. 24A is an exemplary graph of reverse gate position (RGP) versus time resulting from an implementation of a gate operation mode B, a delay, and a gate operation mode C of the method for decelerating a watercraft of FIG. 22.
Figure 24B:
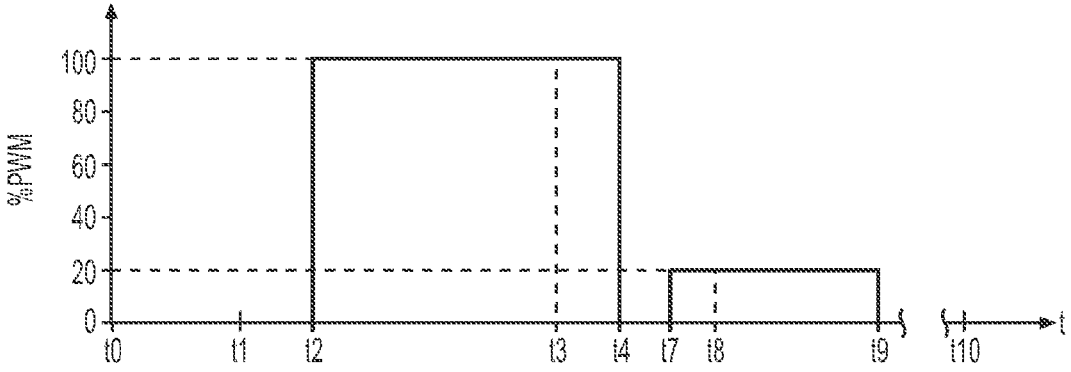
FIG. 24B is an exemplary graph of a power level applied to a reverse gate actuator (% PWM) versus time resulting from the implementation of the gate operation mode B, the delay, and the gate operation mode C of the method for decelerating a watercraft of FIG. 22.
Figure 24C:
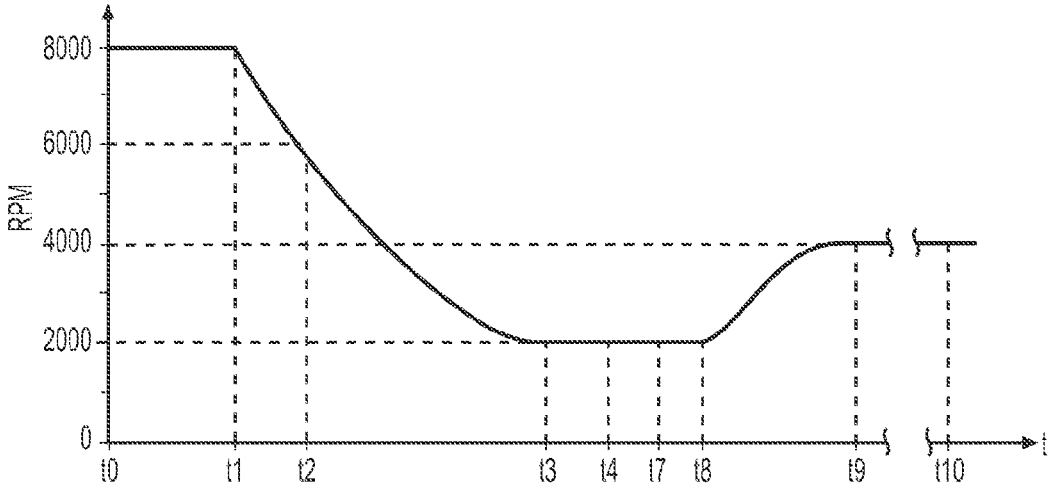
FIG. 24C is an exemplary graph of motor speed (RPM) versus time resulting from the implementation of the gate operation mode B, the delay, and the gate operation mode C of the method for decelerating a watercraft of FIG. 22.

From time t3 to time t4, he ECU 228 continues to cause power to be applied to the reverse gate actuator 196 at 100% PWM. Also from time t3 to time t4, the ECU 228 continues to have a motor speed request corresponding to the idle speed and therefore continues to send signals to the ignition system 222, the fuel injection system 220 and the throttle valve actuator 226 to control these elements such that the motor speed of the engine 22 is reduced to 2000 rpm. In the present example, as can be seen in FIG. 24C, from time t3 to time t4 (and up to t8), the engine 22 turns at 2000 RPM. It is however contemplated that the engine 22 could reach the idle speed sooner or later than illustrated.

As in the example of FIGS. 23A to 23D, at time t4 the reverse gate 110 reaches the neutral position (FIG. 18). At time t4 the ECU 228 receives a signal from the reverse gate position sensor 197 that the reverse gate 110 has reached the neutral position. As a result, the ECU 228 stops controlling the engine 22 and the reverse gate actuator 196 according to the reverse gate operation mode B and proceeds from step 312, to step 314 (DDP stays the same), to step 316 and then to step 318 of the method illustrated in FIG. 22.

Figure 24D:
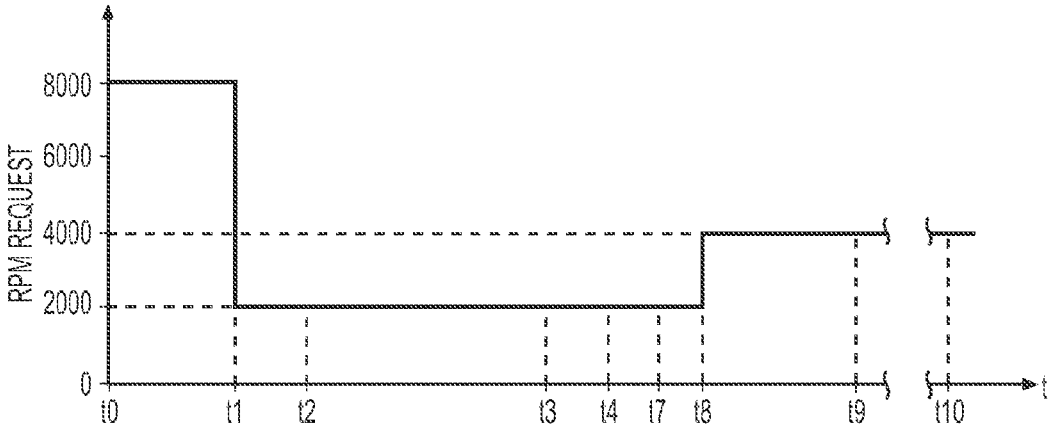
FIG. 24D is an exemplary graph of motor speed request (RPM request) versus time resulting from the implementation of the gate operation mode B, the delay, and the gate operation mode C of the method for decelerating a watercraft of FIG. 22.

At time t4, the ECU 228 applies the delay of step 318. This delay lasts from time t4 to time t7. At time t4, as can be seen in FIGS. 24A and 24B, the ECU 228 causes power to stop being applied to the reverse gate actuator 196, which accordingly stops rotating the reverse gate 110 and keeps it in a fixed position at the neutral position until time t7. From time t4 to time t7, the ECU 228 continues to have a motor speed request corresponding to the idle speed as can be seen in FIGS. 24C and 24D. It is contemplated that the delay of step 318 could be applied at an intermediate position other than the neutral position or that the delay of step 318 could be omitted.

At the end of the delay of step 318, the ECU 228 proceeds from step 318 to step 320 to control the various components of the watercraft 10 according to the reverse gate operation mode C. At time t7, the ECU 228 causes a power level corresponding to the deceleration signal indicative of the actuated position of the deceleration device 77 to be applied to the reverse gate actuator 196. In the present example, the driver actuates the deceleration device at an actuated position that is between the predetermined position X and 40% of the full range of motion of the deceleration device 77, which, in the present example, corresponds to a power level of 20% PWM. As a result, the reverse gate 110 starts rotating again toward the fully lowered position. From time t7 to time t8, the ECU 228 continues to have a motor speed request corresponding to the idle speed as can be seen in FIGS. 24C and 24D. In the present implementation, actuated positions of 60%, 70% and 80% correspond to power levels of 35%, 55% and 75%, respectively. If between t8 and t9 the driver were to change the actuated position of the deceleration device 77, the power level applied to the reverse gate actuator 196 would change accordingly.

At time t8 the reverse gate is at a position P5 that is closer to the neutral position than the fully lowered position. When the reverse gate 110 reaches position P5, the ECU 228 sends signals to the ignition system 222, the fuel injection system 220 and the throttle valve actuator 226 to control these elements such that the motor speed of the engine 22 is gradually increased to 4000 rpm. As can be seen in FIG. 24C, starting at time t8, the motor speed starts increasing in response to the increase of the motor speed request. In the present example, the motor speed request will remain at 4000 rpm for the remainder of the method until the deceleration device 77 is released. It is contemplated that the motor speed request could be increased sooner than time t8, such as during the delay between times t4 and t7 or before the delay (i.e. before time t4). In one alternative example, the motor speed request is increased at time t3 as in the example of FIGS. 23A to 23D, such that the curves of FIGS. 24C and 24D would look the same as those of FIGS. 23C and 23D. It is also contemplated that the motor speed request beginning at time t8 could be different than illustrated. For example, the motor speed request beginning at time t8 could depend on the deceleration device position, with the motor speed request increasing as the position of the deceleration device 77 increases. It is also contemplated that the motor speed request beginning at time t8 could depend on the position of the throttle operator 76.

After time t8, the power level of 20% PWM continues to be applied to the reverse gate actuator 196, the reverse gate 110 continues to be lowered and reaches its fully lowered position P4 at time t9. Also, after time t8, the motor speed continues to increase until it reaches the watercraft deceleration speed of 4000 rpm slightly before time t9. It is contemplated that the watercraft deceleration speed could be reached sooner before time t9 or after time t9.

At time t9, since the revere gate has reached the fully lowered position 196, the ECU 228 stops controlling in the reverse gate operation mode C and proceeds from step 322 to step 310. As a result, at time t9, as can be seen in FIG. 24B the ECU 228 causes power to stop being applied to the reverse gate actuator 196. From time t9, the reverse gate 110 remains in the fully lowered position P4 and the motor speed remains at the watercraft deceleration speed of 4000 rpm. The thrust resulting form the water being redirected forward by the reverse gate 110 decelerates the watercraft 10 until it reaches a watercraft speed of 0 km/h at time t10. At time t10, should the deceleration device 77 continue to be actuated, since the reverse gate 110 remains in the fully lowered position P4 and the motor speed is still 4000 rpm, the watercraft 10 starts moving in the reverse direction.

As would be understood from comparing the slope of the curve from time t2 to time t4 to the slope of the curve from time t7 to time t9 in FIG. 24A, the speed of rotation of the reverse gate 110 is greater from time t2 to time t4 during the reverse gate operation mode B than from time t7 to time t9 during the reverse gate operation mode C. As would be understood from the description of step 320 above, by moving the deceleration device 77 to a position that causes a higher power level to be applied to the reverse gate actuator 196 starting at time t7, the reverse gate 110 would rotate faster and would therefore reach the fully lowered position P4 sooner. As such, the time between time t7 and time t9 would be shorter.

It is contemplated that the power level applied to the reverse gate actuator 196 from time t2 to time t4 could not be constant and/or could be less than 100% PWM. It is also contemplated that the power level applied to the reverse gate actuator 196 from time t7 to time t9 could not be constant and/or could be less than 20% PWM for the same position of the deceleration device 77.

As can be seen by comparing FIGS. 23A to 24A, the time taken to move the reverse gate 110 from the fully stowed position to the fully lowered position is shorter in the example of FIG. 23A (time t1 to time t5) than in the example of FIG. 24A (time t1 to time t9). As such, the reverse gate 110 is fully lowered faster when the ECU 228 controls the engine 22 and reverse gate actuator 196 according to the reverse gate operation mode A (i.e. the deceleration device position is greater than or equal to the predetermined position Y) than when the ECU 228 controls the engine 22 and reverse gate actuator 196 according to the reverse gate operation modes B and C and applies the delay between these modes (i.e. the deceleration device position is less than the predetermined position Y). Therefore, the average speed of rotation of the reverse gate 110 from time t1 to time t5 in FIG. 23A is greater than from time t1 to time t9 in FIG. 24A. Also, the watercraft 10 reaches a speed of 0 km/h sooner when the deceleration device position is greater than or equal to the predetermined position Y (i.e. time t6 in the example of FIGS. 23A to 23D) than when the deceleration device position is less than the predetermined position Y (i.e. time t10 in the example of FIGS. 24A to 24D). As would also be understood from the varying slopes of the curves in FIGS. 23A and 24A, in the operation modes A, B and C, the instantaneous speed of rotation of the reverse gate 110 varies over time as it is rotated from the stowed position to the deceleration position.

In the examples of FIGS. 23A to 23D and FIGS. 24A to 24D, the reverse gate 110 is lowered all the way to its fully lowered position P4 in order to decelerate the watercraft 10. It is contemplated that the reverse gate 110 could only be lowered to a position intermediate the neutral position P3 and the fully lowered position P4, such as the position illustrated in FIG. 19 for example. In such an implementation, times t5 and t9 would correspond to the time at which the reverse gate 110 reaches this position. All these positions of the reverse gate 110 deflect the jet of water expelled by the jet propulsion system 84 such that the deflected jet has a forward component thus generating a deceleration thrust to decelerate the watercraft 10. The position of the reverse gate 110 up to which it is lowered to decelerate the watercraft 10 in the method described above is referred to as the deceleration position. In the examples of FIGS. 23A to 23D and FIGS. 24A to 24D, the deceleration position is the fully lowered position P4. In implementations where the deceleration position is not the fully lowered position P4, it is contemplated that once the watercraft 10 has decelerated to 0 km/h, or close to it, that the reverse gate 110 could be moved to the fully lowered position P4 to move the watercraft 10 in reverse.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A method for decelerating a watercraft, the watercraft having a hull, a deck disposed on the hull, a seat disposed on the deck, a motor connected to at least one of the hull and the deck, a jet propulsion system operatively connected to the motor, a reverse gate connected to at least one of the hull and the jet propulsion system, the reverse gate being movable between at least a stowed position and a deceleration position, and a reverse gate actuator operatively connected to the reverse gate for moving the reverse gate between at least the stowed position and the deceleration position, the method comprising:

receiving, in a control unit, a deceleration signal from a deceleration device position sensor, the deceleration signal being indicative of an actuated position of a deceleration device, the deceleration device having multiple actuated positions;

controlling, by the control unit, an operation of the reverse gate actuator based at least in part on the actuated position of the deceleration device; and moving the reverse gate from the stowed position to the deceleration position with the reverse gate actuator, the reverse gate actuator being controlled such that a speed of rotation of the reverse gate varies based at least in part on the actuated position of the deceleration device.

2. The method of claim 1, wherein:

controlling the operation of the reverse gate actuator includes:

controlling the reverse gate actuator to operate according to a first operation mode as the reverse gate moves from the stowed position to an intermediate position of the reverse gate, the intermediate position being intermediate the stowed and deceleration positions; and controlling the reverse gate actuator to operate according to a second operation mode as the reverse gate moves from the intermediate position to the deceleration position; and the speed of rotation of the reverse gate varies based at least in part on the one of the first and second operation modes according to which the reverse gate actuator is being controlled.

3. The method of claim 2, wherein the reverse gate actuator moves the reverse gate faster in the first operation mode than in the second operation mode.

4. The method of claim 3, wherein:

the first operation mode is independent of the actuated position of the deceleration device; and the second operation mode is dependent on the actuated position of the deceleration device.

5. The method of claim 4, wherein, in the second operation mode, the reverse gate actuator moves the reverse gate slower as the actuated position of the deceleration device is smaller.

6. The method of claim 3, wherein moving the reverse gate toward the deceleration position with the reverse gate actuator includes:

moving the reverse gate from the stowed position to the intermediate position with the reverse gate actuator operating according to the first operation mode;

stopping the reverse gate at the intermediate position for a time delay; and once the time delay has expired, moving the reverse gate from the intermediate position to the deceleration position with the reverse gate actuator operating according to the second operation mode.

7. The method of claim 6, wherein the time delay is constant.

8. The method of claim 3, wherein the intermediate position is a neutral position of the reverse gate.

9. The method of claim 1, wherein:

when the actuated position of the reverse gate actuator is less than a predetermined position, controlling the operation of the reverse gate actuator includes:

controlling the reverse gate actuator to operate according to a first operation mode as the reverse gate moves from the stowed position to an intermediate position of the reverse gate, the intermediate position being intermediate the stowed and decelerations positions; and controlling the reverse gate actuator to operate according to a second operation mode as the reverse gate moves from the intermediate position to the deceleration position;

when the actuated position of the reverse gate actuator is greater than the predetermined position, controlling the operation of the reverse gate actuator includes:

controlling the reverse gate actuator to operate according to a third operation mode as the reverse gate moves from the stowed position to the deceleration position; and the speed of rotation of the reverse gate varies based at least in part on the one of the first, second and third operation modes according to which the reverse gate actuator is being controlled.

10. The method of claim 9, wherein the reverse gate actuator moves the reverse gate faster in the first and third operation modes than in the second operation mode.

11. The method of claim 10, wherein:

the first and third operation modes are independent of the actuated position of the deceleration device; and the second operation mode is dependent on the actuated position of the deceleration device.

12. The method of claim 10, wherein:

when the actuated position of the reverse gate actuator is less than the predetermined position, moving the reverse gate toward the deceleration position with the reverse gate actuator includes:

moving the reverse gate from the stowed position to the intermediate position with the reverse gate actuator operating according to the first operation mode;

stopping the reverse gate at the intermediate position for a time delay; and once the time delay has expired, moving the reverse gate from the intermediate position to the deceleration position with the reverse gate actuator operating according to the second operation mode; and when the actuated position of the reverse gate actuator is greater than the predetermined position, moving the reverse gate toward the deceleration position with the reverse gate actuator includes:

moving the reverse gate uninterruptedly from the stowed position to the deceleration position with the reverse gate actuator operating according to the third operation mode.

13. The method of claim 1, further comprising:

reducing a thrust request upon receiving the deceleration signal prior to moving the reverse gate toward the deceleration position;

reducing a speed of the motor in response to the reduction of the thrust request;

continuing to reduce the speed of the motor as the reverse gate moves toward an intermediate position of the reverse gate, the intermediate position being intermediate the stowed and decelerations positions;

increasing the thrust request at the intermediate position of the reverse gate; and increasing the speed of the motor in response to increasing the thrust request.

14. A watercraft comprising:

a hull;

a deck disposed on the hull;

a seat disposed on the deck;

a motor connected to one of the hull and the deck;

a jet propulsion system operatively connected to the motor;

an electronic control unit (ECU) communicating with the motor for controlling an operation of the motor;

a reverse gate operatively connected to at least one of the hull and the jet propulsion system, the reverse gate being movable between at least a stowed position and a deceleration position;

a reverse gate actuator operatively connected to the reverse gate for moving the reverse gate between at least the stowed position and the deceleration position, and being in communication with the ECU;

a deceleration device position sensor in communication with the ECU; and a deceleration device connected to the deceleration device position sensor, the deceleration device position sensor sensing a position of the deceleration device, the ECU being configured to, upon receiving a deceleration signal indicative of an actuation of the deceleration device from the deceleration device position sensor, send an actuation signal to the reverse gate actuator to move the reverse gate toward the deceleration position, the actuation signal being based at least in part on an actuated position of the deceleration device, the deceleration device having multiple actuated positions, and a speed of rotation of the reverse gate varying based at least in part on the actuated position of the deceleration device.

15. The watercraft of claim 14, wherein:

the actuation signal includes a first actuation signal and a second actuation signal;

the ECU is configured to, upon receiving the deceleration signal indicative of the actuation of the deceleration device from the deceleration device position sensor:

send the first actuation signal to the reverse gate actuator to move the reverse gate from the stowed position to an intermediate position of the reverse gate, the intermediate position being intermediate the stowed and decelerations positions; and send the second actuation signal to the reverse gate actuator to move the reverse gate from the intermediate position to the deceleration position; and the reverse gate actuator moves the reverse gate faster when the ECU sends the first actuation signal than when the ECU sends the second actuation signal.

16. The watercraft of claim 14, wherein the reverse gate actuator is an electric motor.

17. A method for decelerating a watercraft, the watercraft having a hull, a deck disposed on the hull, a seat disposed on the deck, a motor connected to at least one of the hull and the deck, a jet propulsion system operatively connected to the motor, a reverse gate connected to at least one of the hull and the jet propulsion system, the reverse gate being movable between at least a stowed position and a deceleration position, and a reverse gate actuator operatively connected to the reverse gate for moving the reverse gate between at least the stowed position and the deceleration position, the method comprising:

receiving, in a control unit, a deceleration signal from a deceleration device position sensor, the deceleration signal being indicative of an actuated position of a deceleration device;

controlling, by the control unit, an operation of the reverse gate actuator based at least in part on the actuated position of the deceleration device; and moving the reverse gate from the stowed position to the deceleration position with the reverse gate actuator, the reverse actuator being controlled such that a time taken for moving the reverse gate from the stowed position to the deceleration position varies depending at least in part on the actuated position of the deceleration device, the time starting from the reception of the deceleration signal by control unit.

18. The method of claim 17, wherein the operation of the reverse gate actuator is controlled such that an average speed of rotation of the reverse gate over the time is based at least in part on the actuated position of the deceleration device.

19. The method of claim 18, wherein the operation of the reverse gate actuator is controlled such that an instantaneous speed of rotation of the reverse gate varies from the stowed position to the deceleration position.

20. The method of claim 18, wherein the reverse gate actuator is controlled to:

rotate the reverse gate at a first speed of rotation from the stowed position to an intermediate position, the intermediate position being intermediate the stowed and deceleration positions; and rotate the reverse gate at a second speed of rotation from the intermediate position to the deceleration position, the second speed of rotation being less than the first speed of rotation.

* * * * *